US009657422B2

(12) United States Patent
Jeong et al.

(10) Patent No.: US 9,657,422 B2
(45) Date of Patent: May 23, 2017

(54) WASHING MACHINE

(71) Applicant: LG ELECTRONICS INC., Seoul (KR)

(72) Inventors: Jaeyong Jeong, Seoul (KR); Youngjong Kim, Seoul (KR); Kyubum Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 192 days.

(21) Appl. No.: 14/452,591

(22) Filed: Aug. 6, 2014

(65) Prior Publication Data

US 2015/0040620 A1 Feb. 12, 2015

(30) Foreign Application Priority Data

Aug. 6, 2013 (KR) ..... 10-2013-0093250
Aug. 6, 2013 (KR) ..... 10-2013-0093251

(51) Int. Cl.

| | |
|---|---|
| ***D06F 13/02*** | (2006.01) |
| ***D06F 17/10*** | (2006.01) |
| ***D06F 39/08*** | (2006.01) |
| ***D06F 39/10*** | (2006.01) |
| *D06F 17/08* | (2006.01) |

(52) U.S. Cl.

CPC ..... *D06F 17/10* (2013.01); *D06F 13/02* (2013.01); *D06F 39/08* (2013.01); *D06F 39/10* (2013.01); *D06F 17/08* (2013.01); *D06F 39/083* (2013.01)

(58) Field of Classification Search

CPC ..... D06F 13/02
See application file for complete search history.

(56) References Cited

U.S. PATENT DOCUMENTS 5,727,404 A * 3/1998 Cho ..... D06F 17/06 68/133
5,921,114 A * 7/1999 Jung ..... D06F 17/10 68/133
2003/0200774 A1 10/2003 Kim et al.

FOREIGN PATENT DOCUMENTS

| | | |
|---|---|---|
| CN | 1252339 | 4/2006 |
| CN | 1779050 | 5/2006 |
| KR | 10-2005-0088613 A | 9/2005 |
| KR | 10-2011-009536 A | 1/2011 |
| KR | 10-2013-0037416 A | 4/2013 |

OTHER PUBLICATIONS

International Search Report dated Dec. 30, 2014 issued in Application No. PCT/KR2014/007228.
Chinese Office Action (with full English translation) dated Dec. 19, 2016 issued in Application No. 201480055142.6.

* cited by examiner

*Primary Examiner* — Jason Ko
(74) *Attorney, Agent, or Firm* — KED & Associates, LLP

(57) ABSTRACT

A washing machine of the present invention includes: an inner tub receiving laundry; a pulsator rotatably disposed in the inner tub; and guides disposed on the pulsator and guiding washing water, which is turned circumferentially in the inner tub, to the rotational center axis of the inner tub by hitting against the washing water.

20 Claims, 17 Drawing Sheets

(a)

(b)

(a)

(b)

WASHING MACHINE

CROSS-REFERENCE TO RELATED APPLICATIONS

This application claims priority under 35 U.S.C. §119 to Korean Application Nos. 10-2013-0093250 and 10-2013-0093251, both filed on Aug. 6, 2013, whose entire disclosures are hereby incorporated by reference.

BACKGROUND

1. Field

The present invention relates to a washing machine, particularly a washing machine with a rotatable pulsator generating a water vortex in an inner tub with laundry therein.

2. Background

In general, a washing machine means various apparatuses that process laundry such as clothing and bed linen by applying physical and/or chemical action to them.

A washing machine may include an outer tub receiving washing water and an inner tub rotatably disposed inside the outer tub receiving laundry. The washing machine may be equipped with a rotatable pulsator on the bottom inside the inner tub. The washing machine can remove dirt from laundry, using a friction force between the laundry and the pulsator, and the washing ability may be largely influenced by the rotation of the pulsator.

The laundry in the inner tub is moved by the physical force (for example, friction force) by the rotation of the pulsator or the water vortex generated in the inner tub and it is preferable that the laundry is uniformly distributed in the inner tub. Further, it is preferable that the pulsator rotates such that a detergent in the washing water can be uniformly dissolved.

The above references are incorporated by reference herein where appropriate for appropriate teachings of additional or alternative details, features and/or technical background.

SUMMARY

An object of the present invention is to guide washing water so that a pulsator can make various movement patterns of laundry in an inner tub.

Another object of the present invention is to improve washing ability by collecting dirt in the washing water sprayed to an inner tub from a pulsator.

The objects of the present invention are not limited to those described above and other objects may be made apparent to those skilled in the art from the following description.

The present invention has been made in an effort to provide a washing machine including: an inner tub receiving laundry; a pulsator rotatably disposed in the inner tub; and guides disposed on the pulsator and guiding washing water, which is turned circumferentially in the inner tub, to the rotational center axis of the inner tub by hitting against the washing water.

The guides may be curved so that washing water pushed outward from the rotational center returns, making a curve.

The guides may be symmetrically arranged to obtain same effect, when the pulsator rotates for stirring.

The pulsator may include: an inner pulsator; and an outer pulsator disposed outside the inner pulsator, rotating with the inner pulsator, and having the guides.

The outer pulsator may have: a cylindrical side disposed under the inner tub and mounted with the guides; and an extension disposed between the side and the outer side of the inner pulsator.

The inner tub may include: an inner tub base covering the outer side of the side wall; and a cylindrical inner tub body disposed on the inner tub base, and an outer anti-sticking rib curved to cover the upper edge of the side wall may be formed at the joint of the inner tub base and the inner tub body.

The washing machine may further include: a sun gear having an inner pulsator-coupling portion coupled to the inner pulsator; planetary gears engaged with the sun gear; a ring gear engaged with the planetary gears, on the inner side; and a gear box rotating with the ring gear.

The pulsator may further include a base pulsator disposed under the outer pulsator, fastened to the gear box, and transmitting torque from the ring gear to the outer pulsator.

A sun gear hole through which the inner pulsator-coupling portion passes may be formed through the base pulsator.

The washing machine may include a planetary gear set rotating the inner pulsator and the outer pulsator in opposite directions.

The inner pulsator and the outer pulsator may rotate, maintaining different angular speed ratios.

The outer pulsator may have a cylindrical side wall disposed under the inner tub, and the guide may have an edge protruding toward the center axis of the inner tub and inclined surfaces connecting the edge with the side wall.

The inclined surfaces may include a first inclined surface against which washing water that flows hits and a second inclined surface by which washing water flowing over the edge generates a vortex by turning, after curvedly flowing along the first inclined surface.

The washing machine may further include an outer tub surrounding the inner tub, in which the inclined surfaces may be curved convexly toward the outer tub.

A washing machine of the present invention includes: an inner tub receiving laundry; a pulsator having circulation channels through which washing water in the inner tub flows; and filters mounted on the pulsator to filter washing water flowing through the circulation channels.

The pulsator may include: a collection space where dirt filtered by the filter is collected; an inner tub-communicating unit that enables the collection space and the inner tub to communicate with each other; and a circulation channel-communicating portion that enables the collection space and the circulation channel to communicate with each other.

The filter may further have a flow stopper that blocks dirt collected in the collection space to prevent the dirt from flowing backward to the circulation channel and a locking step that restricts movement of the flow stopper so that the flow stopper pivots in the collection space.

The filter may include a housing disposed in the collection space and receiving dirt, and the housing may have an inner tub opening that communicates with the inner tube-communicating portion and a circulation channel opening that communicates with the circulation channel-communicating portion.

The pulsator may have separators that define the collection space.

The housing may have mounting portions elastically being in contact with the separators to prevent separation from the pulsator.

The pulsator may have separators that define the collection space and the housing may have mounting portions elastically being in contact with the separators to prevent separation from the pulsator.

The housing may have separators that divide washing water.

The filter may have a filter portion hinged to the pulsator or the housing to open/close the inner tub-communicating portion.

The filter may have a filtering portion slidably disposed in the pulsator or the housing to open/close the inner tub-communicating portion.

The washing machine may further include an outer tub disposed outside the inner tub, in which the pulsator has inlet holes at the lower portion so that washing water in the outer tub flows into the circulation channel.

The pulsator may include: an inner pulsator having the circulation channel; and an outer pulsator having the same rotational center axis as the inner pulsator and mounted with the filter.

The pulsator may further include a base pulsator disposed under the inner pulsator, connected with the outer pulsator, and having inlet holes for washing water to flow into the circulation channel.

A rim covering the edge of the inner pulsator may be formed at the outer pulsator and a circulation channel-communicating portion open to communicate with the circulation channel may be formed at the rim.

According to the present invention, it is possible to minimize tangling of laundry and improve washing ability by increasing fluidity of washing water with the guides on the outer tub and by generating a vortex.

Further, it is possible to improve washing performance by collecting dirt, which is contained in washing water, in the pulsator.

Further, since the inner pulsator and the outer pulsator can rotate at different rotational speeds, it is possible to generate more three-dimensional complex water vortexes in the inner tub and to improve the washing ability.

Further, since the inner pulsator and the outer pulsator can generate water vortexes in opposite directions, it is possible to wash laundry in the inner tub like scrubbing it in washing and further improve the washing performance of the washing machine.

The effects of the present invention are not limited to those described above and other effects not stated herein may be made apparent to those skilled in the art from claims.

BRIEF DESCRIPTION OF THE DRAWINGS

The embodiments will be described in detail with reference to the following drawings in which like reference numerals refer to like elements wherein.

Features and advantages of the present invention will be further understood with reference to the accompanying drawings described below with the following detailed description of embodiments of the present invention, in which.

DETAILED DESCRIPTION

Figure 1:
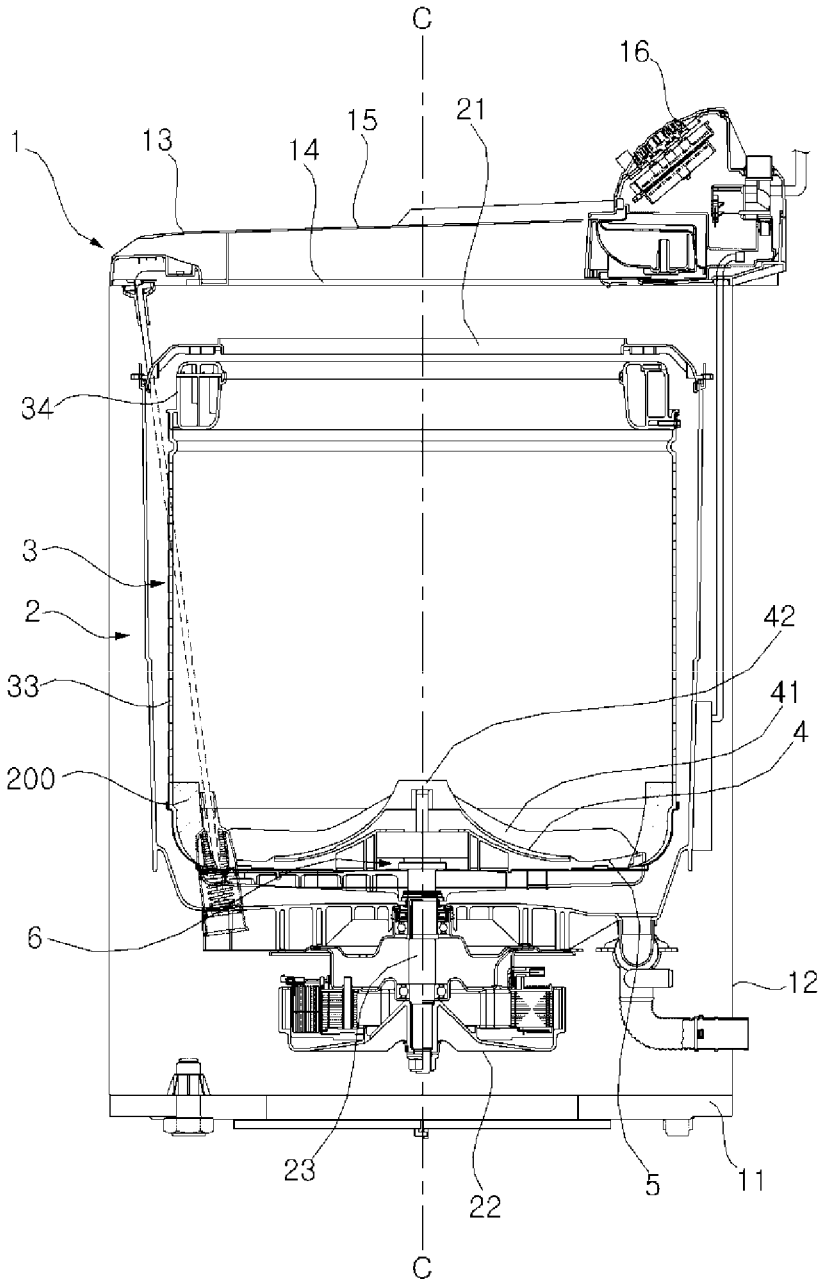
FIG. 1 is a vertical cross-sectional view of a washing machine according to an embodiment of the present invention.

The advantages and features of the present invention, and methods of achieving them will be clear by referring to the embodiments that will be described hereafter in detail with reference to the accompanying drawings. However, the present invention is not limited to the embodiments described hereafter and may be implemented in various ways, the exemplary embodiments are provided to complete the description of the present invention and let those skilled in the art completely know the scope of the present invention, and the present invention is defined by claims. Like reference numerals indicate like components throughout the specification.

Hereinafter, the present invention will be described with reference to the drawings illustrating washing machines according to embodiments of the present invention.

Figure 2:
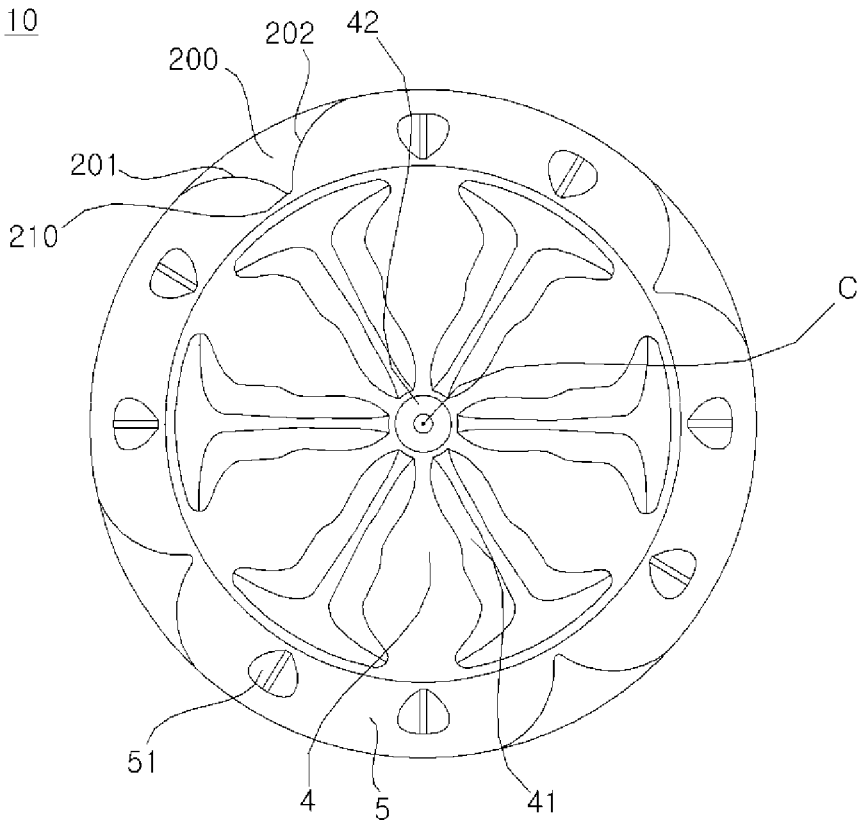
FIG. 2 is a plan view showing a pulsator according to an embodiment of the present invention.
Figure 3:
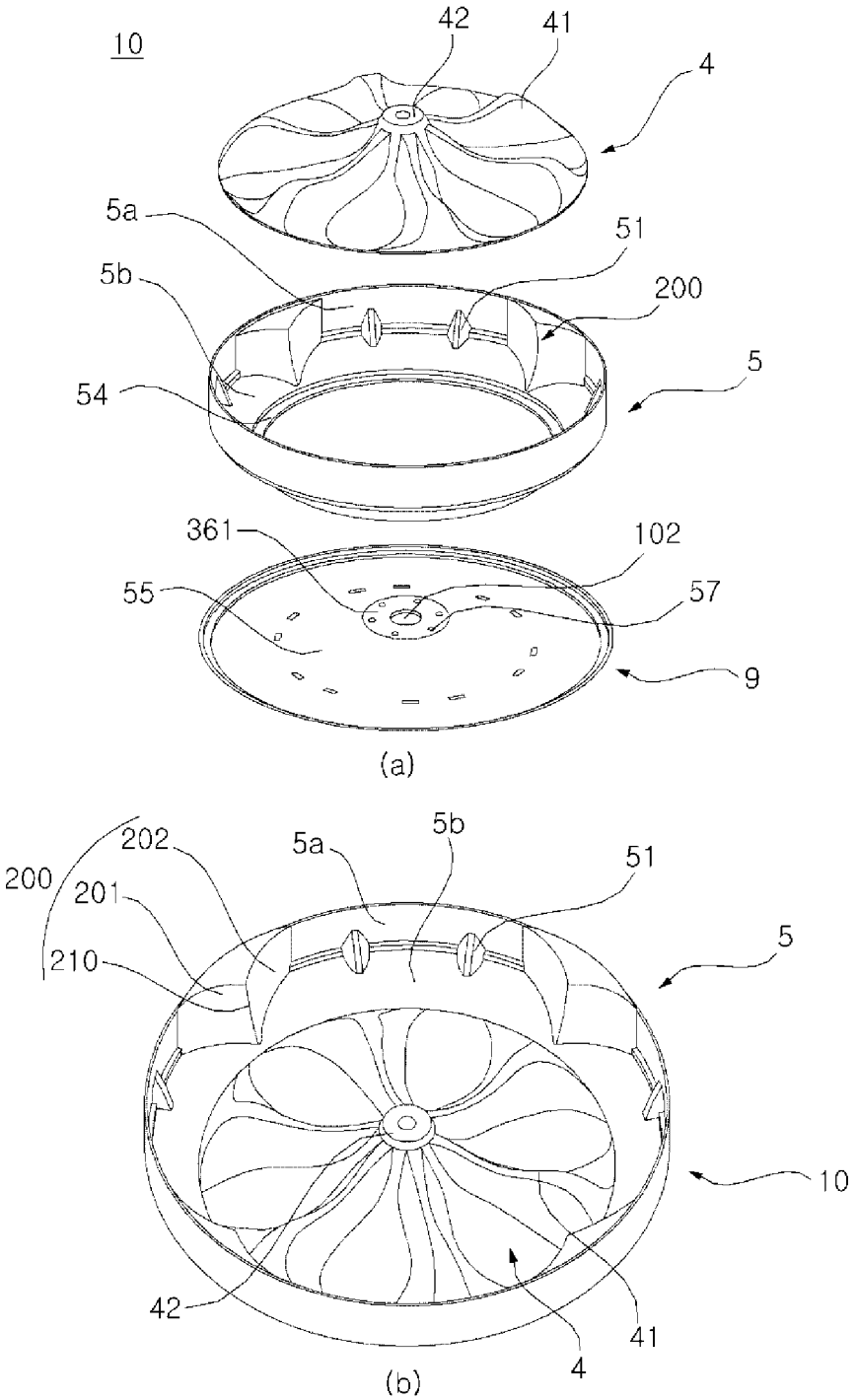
FIG. 3 is a perspective view showing the pulsator according to an embodiment of the present invention.
Figure 4:
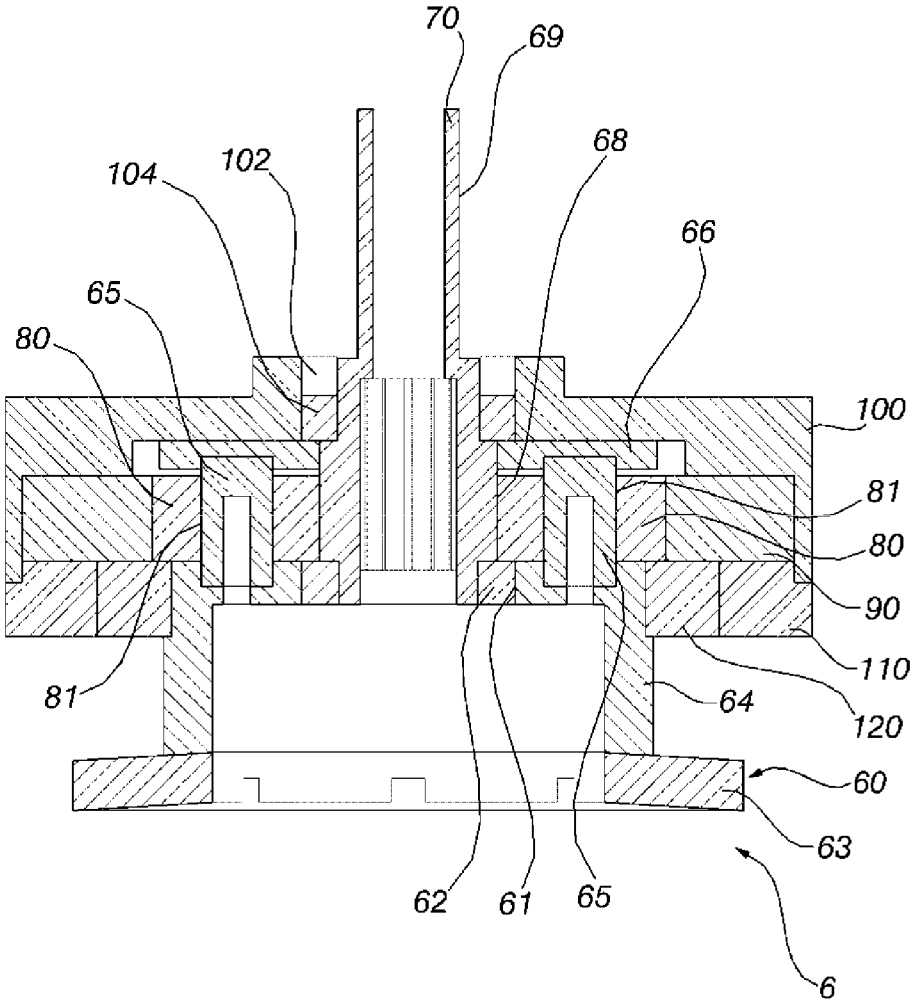
FIG. 4 is a cross-sectional view showing a planetary gear set according to an embodiment of the present invention.
Figure 5:
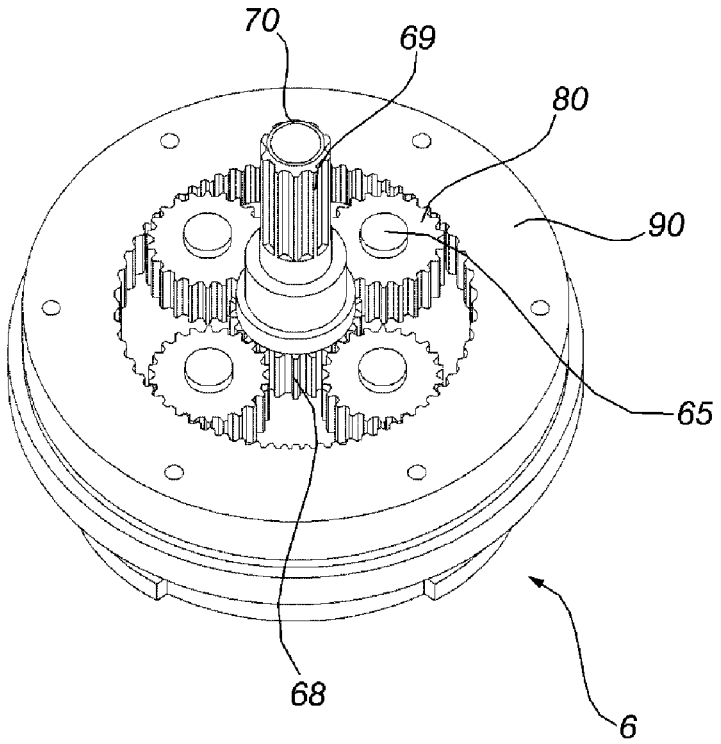
FIG. 5 is a perspective view showing the inside of the planetary gear set according to an embodiment of the present invention.
Figure 6:
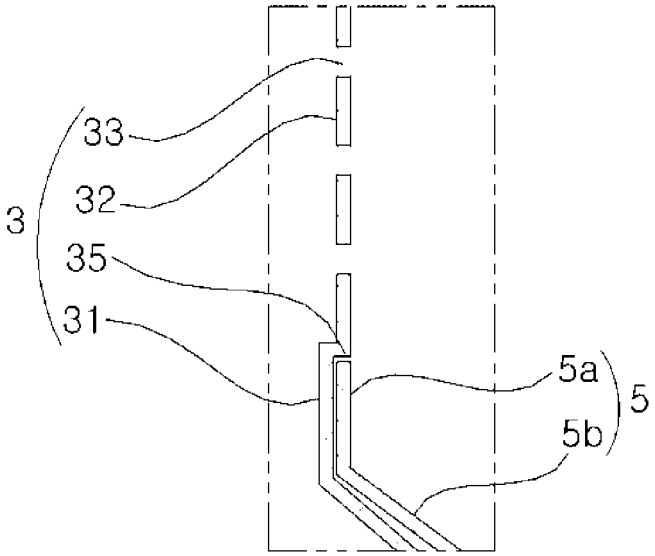
FIG. 6 is a partial cross-sectional view showing an outer anti-sticking rib according to an embodiment of the present invention.

FIG. 1 is a vertical cross-sectional view of a washing machine according to an embodiment of the present invention, FIG. 2 is a plan view showing a pulsator according to an embodiment of the present invention, and FIGS. 3A and 3B are an exploded perspective view showing the pulsator according to an embodiment of the present invention and a perspective view when the pulsator is assembled, respectively. FIG. 3A is a perspective view when a pulsator is disassembled and FIG. 3B is a perspective view when the pulsator is assembled. FIG. 4 is a cross-sectional view showing a planetary gear set according to an embodiment of the present invention and FIG. 5 is a perspective view showing the inside of the planetary gear set according to an embodiment of the present invention.

A washing machine includes an inner tub 3 receiving laundry, a pulsator 10 rotatably disposed in the inner tub 3, and guides 200 that washing water circumferentially circulated in the inner tub 3 hits against to be guided to a rotational center axis C of the inner tub 3. The guides 200 may be curved so that the washing water moved outward from the rotational center axis C of the inner tub 3 can return, making a curve. The guides 200 are symmetrically arranged to generate the same effect in stirring rotation.

The washing machine may include a casing 1. The casing 1 may form the external appearance of the washing machine. The casing 1 may include a base 11, a body 12 disposed on the base 11 and forming the outer side of the washing machine, and a top plate 13 disposed on the body 12. At the top plate 13, a laundry entrance 14 through which laundry can loaded and taken out may be formed and a lid 15 opening/closing the laundry entrance may be provided. A control panel 16 for operating the washing machine may be disposed on the casing 1. The control panel 16 may be disposed at the front portion or the rear portion of the top plate 13.

The washing machine may include an outer tub 2 in the casing 1. The outer tub 2 may surround the inner tub 3. The outer tub 2 may be contained with washing water for washing laundry. The outer tub 2 may have an opening 21 at the top through which laundry can be loaded and taken out. The outer tub 2 may absorb shock through a damper or a hanger in the casing 1. The outer tub 2 may be equipped with a motor 22 rotating the pulsator 10. A rotary shaft 23 may be coupled to the motor 23.

Laundry can be loaded in the inner tub 3. The inner tub 3 may be disposed in the casing 1 and inside the outer tub 2, having a smaller size than the outer tub 2. The outer tub 2 is an outer container that is contained with washing water and the inner tub 3 is an inner container in which laundry is washed by washing water.

The pulsator 10 may be rotatably disposed on the bottom inside the inner tub 3.

The pulsator 10 includes an inner pulsator 4 and an outer pulsator 5 disposed outside the inner pulsator 4, having the guides 200, and rotating with the inner pulsator 4.

The motor 22 can rotate the inner pulsator 4 and the outer pulsator 5 and can rotate the inner pulsator 4, the outer pulsator 5, and the inner tub 3. The rotary shaft 23 transmitting torque generated by the motor 22 to the planetary gear set 6 may be disposed in the washing machine. The inner pulsator 4 may be rotatably disposed on the bottom inside the inner tub 3 and can generate vortex of washing water by rotating. The inner pulsator 4 can rotate with the outer pulsator 5. The inner pulsator 4 may be disposed on the outer pulsator 5. The inner pulsator 4 may be an upper pulsator on the outer pulsator 5 and the outer pulsator 5 may be a lower pulsator under the inner pulsator 4. The inner pulsator 4 may have at least one inner projection 41. The inner projection 41 may protrude up on the inner pulsator 4. The inner pulsator 4 may have a planetary gear set-coupling portion 42 at the center to which the planetary gear set 6 is connected. The inner projection 41, which guides water vortex around the inner pulsator 4, may be elongated in the radial direction of the inner pulsator 4. The inner projection 41 may be elongated from the planetary gear set-coupling portion 42 to the edge of the inner pulsator 4. A plurality of inner projections 41 may be circumferentially arranged. The inner ends of inner projections 41 may be connected with the planetary gear set-coupling portion 42. The planetary gear set 6 will be described below.

The outer pulsator 5 may be rotatably disposed on the bottom inside the inner tub 3 and can generate vortex of washing water by rotating. The outer pulsator 5 can rotate with the inner pulsator 4 at a rotation speed different from the inner pulsator 4. The outer pulsator 5 may be larger in size than the inner pulsator 4. The outer pulsator 5 may have at least one outer projection 51. The outer projection 51 may protrude up on the outer pulsator 5. The outer projection 51, which guides water vortex around the outer pulsator 5, may be disposed between the inner pulsator 4 and the inner side of the inner tub 3. The outer projection 51 may be spaced from the inner projection 41. A plurality of outer projections 51 may be spaced from each other in the circumferential direction of the outer pulsator 5. The outer projections 51 may be elongated in the circumferential direction of the outer pulsator 5.

The outer pulsator 5 has a rim 54 formed by bending the portion jointed to the edge of the inner pulsator 4 in order to prevent laundry from being stuck in the gap between the outer pulsator 5 and the inner pulsator 4.

The ring-shaped rim 54 surrounding the edge of the inner pulsator 4 may protrude from the outer pulsator 5. The ring-shaped rim 54 can protect the edge of the inner pulsator 4 and can prevent laundry from being stuck in the gap between the inner pulsator 4 and the outer pulsator 5. That is, the ring-shaped rim 54 can function as an anti-laundry-sticking portion.

The outer pulsator 5 has cylindrical side wall 5*a* with the guides 200 disposed on the bottom inside the inner tub 3 and an extension 5*b* between the side wall 5*a* and the outer edge of the inner pulsator 4. The side wall 5*a* may have a circular ring shape. The side wall 5*a* may have a cylindrical shape. The side wall 5*a* may be in contact with the inner tub. The side wall 5*a* is surrounded by anti-sticking rib, which will be described below.

The inner tub 3 may include an inner tub base 31 disposed under the pulsator 10 and covering the lower portion of the pulsator 10 and an inner tub body 32 on the inner tub base 31. Water holes 33 through which washing water flows inside/outside may be formed through the inner body 32. A balancer 34 may be disposed at the upper portion of the inner tub body 32.

The inner tub base 31 may surround the outer side of the side wall 5*a*. The inner tub body 32 may extend upward from the inner tub base 31. The inner tub body 32 may be formed in a hollow cylindrical shape. An outer anti-sticking rib 35 may be formed by bending the joint of the inner tub case 31 and the inner tub body 32 to cover the upper edge of the side wall 5*a*.

The guides 200 may be positioned at the lower portion inside the inner tub 3. The guides 200 each may have an edge 210 protruding toward the center axis C of the inner tub 3 and inclined surfaces 201 and 202 connecting the side wall 5*a* of the pulsator 10 and the edge 210 to each other. The edge 210 is vertically elongated. The inclined surfaces 201 and 202 may be curved. The inclined surfaces 201 and 202 may be symmetric with respect to the edge 210.

The inclined surfaces 201 and 202 may extend from the side wall 5*a*. The inclined surfaces 201 and 202 may protrude to the inside of the inner tub 3 from the side wall 5*a*. A pair of inclined surfaces 201 and 202 may form the edge by coming in contact with each other. The edge 210 may be vertically elongated. The inclined surfaces 201 and 201 may be curved. The inclined surfaces 201 and 202 may be convex toward the outer tub 2. The guides 200 may be integrally formed with the outer pulsator by pressing.

The inclined surfaces 201 and 202 may include a first inclined surface 201 that hits against washing water that is in motion and a second inclined surface 202 that turns washing water, which flows along a curve of the first inclined surface 201 and then flows over the edge 210, to generate vortex. The second inclined surface 202 may be formed behind the first inclined surface 201. The first inclined surface 201 may be symmetric to the second inclined surface 202 with respect to the edge 210. The first inclined surface 210 and the second inclined surface 202 may be changed, depending on the rotational direction of the outer pulsator.

Referring to FIGS. 4 and 5, the washing machine further include a sun gear 70 with an inner pulsator-coupling portion 69 to which the inner pulsator 4 is coupled, planetary gears 80 engaged with the sun gear 70, and a ring gear 90 engaged with the planetary gears 80 on the inner side. The washing machine may further include a gear box 100 covering the upper portion of the ring gear 90 to rotate with the ring gear 90. The sun gear 70, planetary gears 80, and ring gear 90 can constitute the planetary gear set 6. The planetary gear set 6 may further include the gear box 100.

The pulsator 10 may further include a base pulsator 9 disposed under the outer pulsator 5 and transmitting torque from the ring gear 90 to the outer pulsator 5.

The base pulsator 9 is connected with the outer pulsator 5. The base pulsator 9 and the outer pulsator 5 rotate together. The base pulsator 9 may be connected with the ring gear 90. The base pulsator 9 may be combined with the gear box 100 and connected with the ring gear 90 through the gear box 100. The base pulsator 9 has a sun gear hole 102 through which the inner pulsator-coupling portion 69 passes and is combined with the gear box 100.

The sun gear 70 is connected with the motor 22. The sun gear 70 may be connected to the rotary shaft 23 of the motor 22. The sun gear 70 transmits torque to the inner pulsator 4. The sun gear 70 is connected with the inner pulsator 4.

The planetary gears 80 transmit torque from the sun gear 70 to the ring gear 90.

The gear box 100 may be disposed under the base pulsator 9. The gear box 100 can protect the ring gear 90, the sun gear 70, and the planetary gears 80.

A gear box seat 361 having a space for disposing the gear box 100 is formed at the center of the base pulsator 9. Screw holes 57 and the sun gear hole 102 are formed on the top of the gear box seat 361. The gear box seat 361 is fastened to the gear box 110 and transmits torque to the base pulsator 9. The sun gear 70 is connected with the inner pulsator 4 through the top of the gear box seat 361. The pulsator 310 rotates about the rotational center axis C. The rotary shaft 23 of the motor 22 and the sun gear 70 are arranged on the same line as the rotational center axis C. The planetary gear set 6 may include a fixing hub 60 disposed in the inner tub 3, the sun gear 70 fitted on the rotary shaft 23 and having teeth on the lower portion and the inner pulsator-coupling portion 69 at the upper portion, the planetary gears 80 engaged with the teeth 68 and rotatably disposed on the fixing hub 60, the ring gear 90 with which the planetary gears 80 are engaged on the inner side, and the gear box 100 combined with the ring gear 90.

The fixing hub 60 may be disposed on the bottom inside the inner tub 3. The fixing hub 60 may be disposed on the inner tub base 31 that is the bottom of the inner tub 3. A recession that is recessed downward may be formed at the center of the inner tub base 31 and the fixing hub 60 may be disposed in the recession. The fixing hub 60 may be fastened to the inner tub base 31 by fasteners such as screws. A sun gear hole 61 (lower sun gear hole) through which the sun gear 70 passes may be formed through the fixing hub 60. A lower bearing 62 rotatably supporting the sun gear 70 to the fixing hub 60 may be disposed in the sun gear hole 61. The fixing hub 60 may include a disc 63 having a hole at the center through which the rotary shaft 23 passes and a hub 64 disposed on the disc 63 and having the sun gear hole 61. The hub 64 may have a disc portion on the top of a hollow cylinder and the sun gear hole 61 may be formed through the disc portion. Support shafts 56 rotatably supporting the planetary gears 80 may be disposed on the fixing hub 60. The support shafts 65 can hold the planetary gears 80 such that the planetary gears 80 rotate without revolving around the sun gear 70. The support shafts 65 may be fastened to the fixing hub 60 by fasteners such as pins or screws. The planetary gear set 6 may include a planetary gear holder 66 coupled to the upper portions of the support shafts 65. The sun gear 70 has the teeth 68 at the lower portion for engaging with the planetary gears 80 and the inner pulsator-coupling portion 69 at the upper portion.

The planetary gears 80 may be disposed between the sun gear 70 and the ring gear 90, and they can rotate the ring gear 90 by rotating about the support shafts 65 between the sun gear 70 and the ring gear 90, when the sun gear 70 rotates. The planetary gears 80 each may have a support shaft hole 81 through which the support shaft 65 passes. The planetary gears 80 can rotate about the support shafts 65, between the fixing hub 60 and the planetary gear holder 86. In the planetary gear set 6, the inner sides of the planetary gears 80 or the outer sides of the support shaft 65 may be lubricated.

The ring gear 90 is an internal gear with teeth on the inner side for engaging with the planetary gears 80. The ring gear 90 can rotate in the opposite direction to the rotational direction of the sun gear 70. For example, when the sun gear 70 rotates clockwise, the ring gear 90 can rotate counter-clockwise, and when the sun gear 70 rotates counterclockwise, the ring gear 90 can rotate clockwise. The ring gear 90 may rotate at a lower speed than the sun gear 70. The rotational speed deference between the inner pulsator 4 and the outer pulsator 5 may depend on the gear ratio (1:N) of the sun gear 70 and the ring gear 90 in the planetary gear set 6. It is preferable that the gear ratio of between the sun gear 70 and the ring gear 90 ranges from 2 to 3. The smaller the gear ratio (1:N) between the sun gear 70 and the ring gear 90 of the planetary gear set 6, the more the outer pulsator 5 can rotate at a high speed, and the larger the gear ratio (1:N) between the sun gear 70 and the ring gear 90, the more the outer pulsator 5 can rotate at a low speed. When the rotational speed difference between the outer pulsator 5 and the inner pulsator 4 is too large, improvement of washing ability by rotation of the outer pulsator 5 may be deteriorated and it may be preferable that the gear ratio between the sun gear 70 and the ring gear 90 of the planetary gear set 6 is 1:2 rather tan 1:3.

The gear box 100 forms the external appearance of the top and the side of the planetary gear set 6 and can protect the planetary gears 80 and the ring gear 90. The bottom of the gear box 100 may be open. The gear box 100 can transmit torque from the ring gear 90. The gear box 100 may function as a carrier that transmits torque from the planetary gear set 6 to the outer pulsator 5. In the gear box 100, the top may be fastened to the outer pulsator 5 or the base plate 9 and the side may cover the outer side of the ring gear 90. The gear box 100 can rotate with the ring gear 90. The ring gear 90 can be combined with the gear box 100 by fasteners such as screws. The ring gear 90 may be inserted and fitted in the gear box 100. The ring gear 90 may be attached to the inner side of the gear box 100 by an adhering material such as an adhesive. A sun gear hole 102 (upper sun gear hole) through which the sun gear 70 passes may be formed through the gear box 100. An upper bearing 104 rotatably supporting the sun gear 70 to the gear box 100 may be disposed in the sun gear hole 102.

The planetary gear set 6 may include a lower cover 110 coupled to the bottom of the gear box 100. The lower cover 110 may form the external appearance of the bottom of the planetary gear set 6. The lower cover 110 may function as a ring gear stopper that prevents the ring gear 90 from being unexpectedly separated downward from the gear box 100. The lower cover 110 may have a fitting groove on the upper outer side in which the lower end of the gear box 100 is fitted. A portion of the top may be inserted in the gear box 100. The planetary gear set 6 may include an outer bearing 120 disposed between the lower cover 110 and the fixing hub 60 and supporting the lower cover 110 rotatably to the fixing hub 6.

The inner pulsator 4 can be coupled to the inner pulsator-coupling portion 69. The inner pulsator 4 may have a boss for fitting the inner pulsator coupling portion 69 in the planetary gear set-coupling portion 42. The inner pulsator 4 may have a hole at the planetary gear set-coupling portion 42 through which a screw passes and the screw can be thread-fastened to at least one of the sun gear 70 and the rotary shaft 23 through the hole and the boss.

The outer pulsator 5 may rotate at a lower speed than the inner pulsator 4. The outer pulsator 5 may rotate in the opposite direction to the inner pulsator 4. The base pulsator 9 may have a sun gear through-portion 55 that faces the bottom of the inner pulsator 4 and through which the sun gear 70 passes. The sun gear-through portion 55 may have the gear box seat 361 with the bottom open, at the center. The base pulsator 9 may have the screw holes 57 through which screws for fixing the gear box 100 to the outer pulsator 5 pass, at the sun gear-through portion 55. The screw holes 57 may be formed at the gear box seat 361.

The planetary gear set 6 may be at least partially inserted in the gear box seat 361 and protected by the gear box seat 361. The gear box 100 may be inserted in the gear box seat 361 and fastened around the sun gear-through portion 55 by fasteners such as screws.

The upper portion of the rotary shaft 23 may be disposed in the planetary gear set 6. The rotary shaft 23 may be disposed through the inner tub 3 and the fixing hub 60 of the planetary gear set 6. The rotary shaft 23 may be disposed through the rotary shaft hole of the inner tub 3. The rotary shaft 23 may be disposed through the sun gear hole 61 of the fixing hub 60, together with the sun gear 70. The upper portion of the rotary shaft 23 may be inserted and fitted in the sun gear 70.

The planetary gear set 6 may be configured such that the inner pulsator 4 and the outer pulsator 5 rotate in opposite directions. Further, the inner pulsator 4 and the outer pulsator 5 may rotate with different angular speed ratios. The angular speed ratio may be 2:1 to 3:1.

The planetary gear set 6 can rotate simultaneously the inner pulsator 4 and the outer pulsator 5 and can rotate the inner pulsator 4 and the outer pulsator 5 at different rotation speeds. The rotary shaft 23 may be connected to the planetary gear set 6, and when the rotary shaft 23 rotates, the inner pulsator 4 and the outer pulsator 5 can rotate at different rotation speeds. The planetary gear set 6 can rotate the inner pulsator 4 and the outer pulsator 5 in opposite directions. The planetary gear set 6 can rotate the outer pulsator 5 slower than the inner pulsator 4, in the opposite direction to the rotation direction of the inner pulsator 4.

Figure 7:
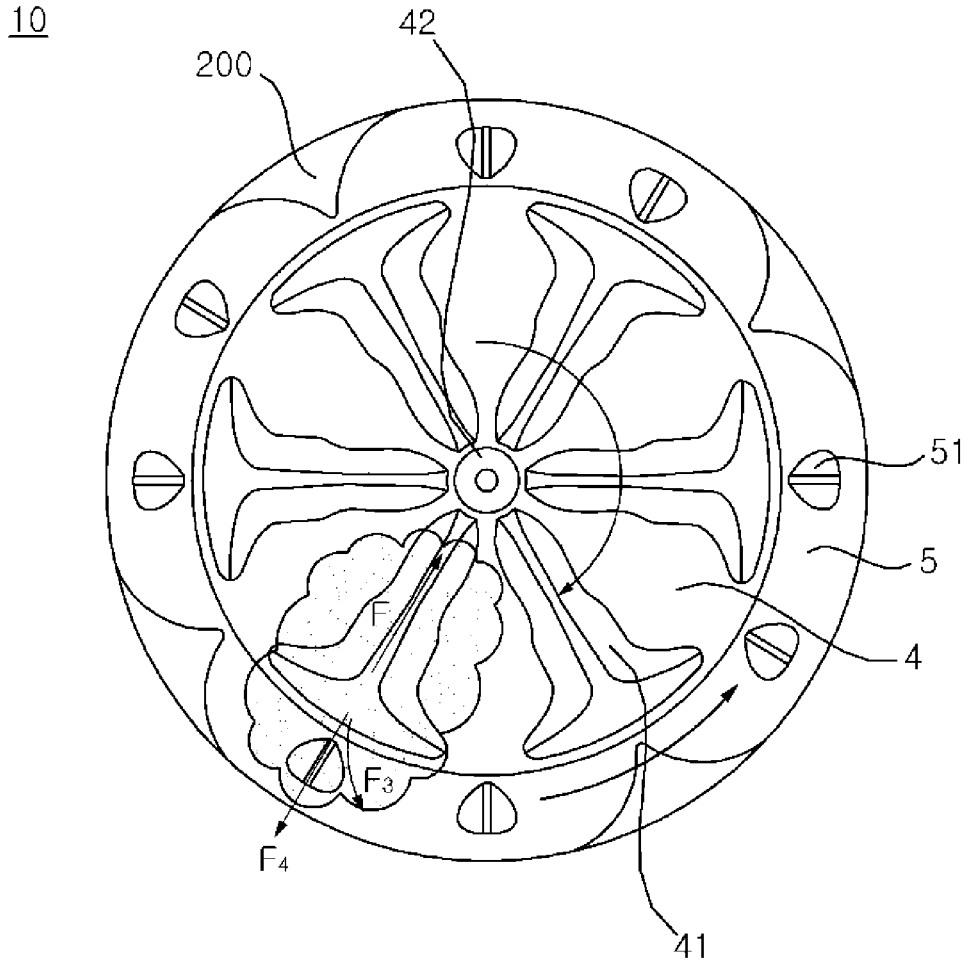
FIG. 7 is a view showing the bottom of an inner tub and the pulsator, according to an embodiment of the present invention.
Figure 8:
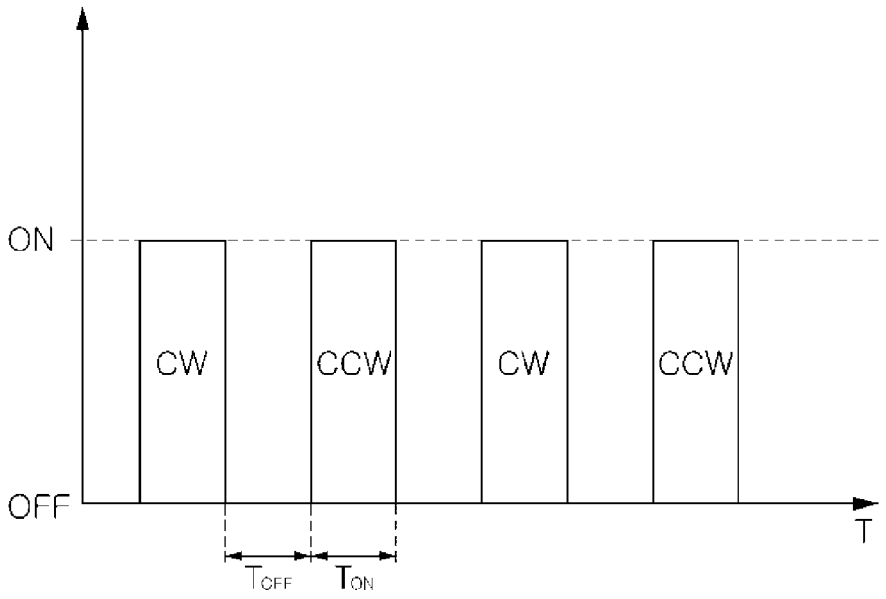
FIG. 8 is a view showing control of an actuating unit when the pulsator rotates for stirring.
Figure 9:
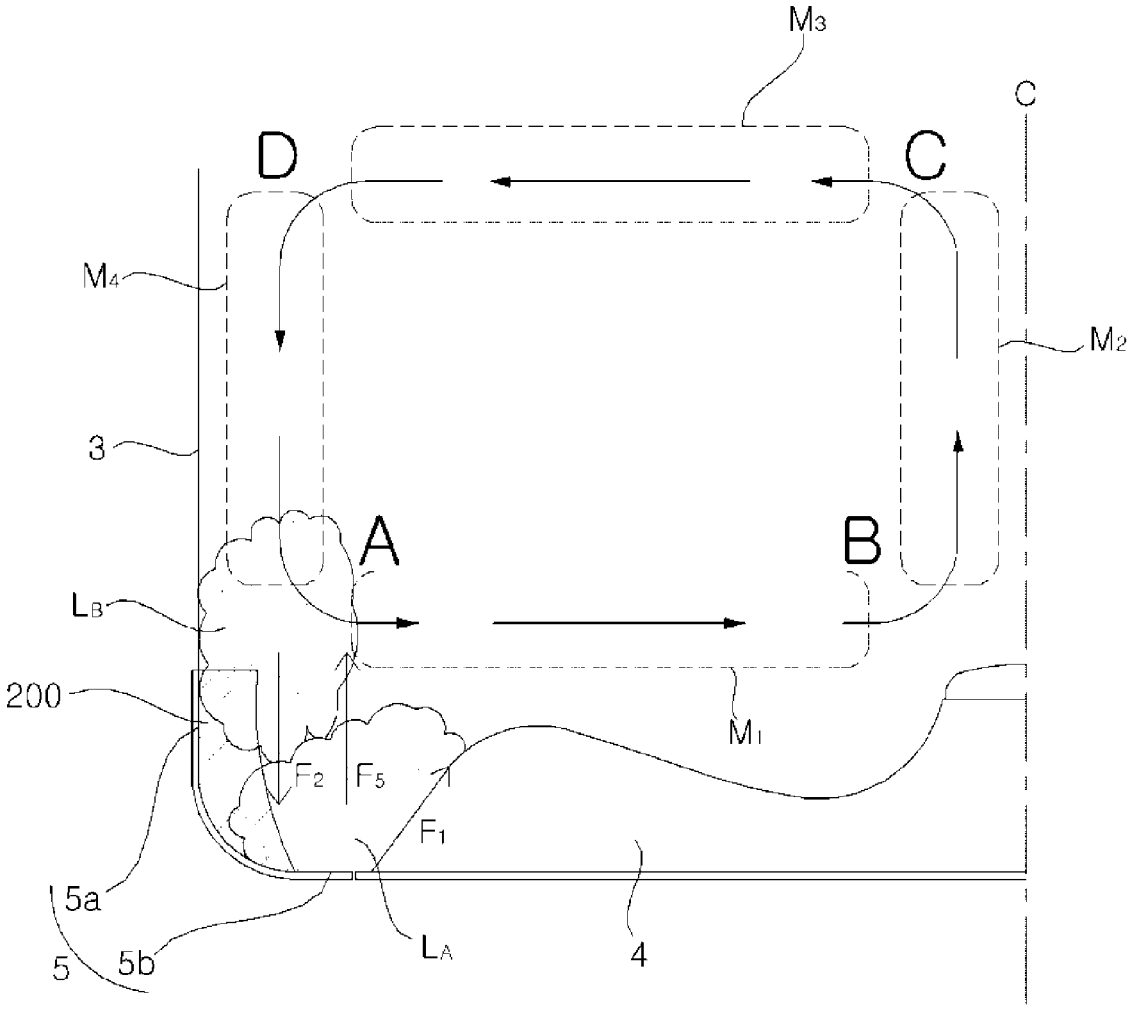
FIG. 9 is a view showing a scrubbing motion.

FIG. 7 is a view showing the bottom of an inner tub and the pulsator, according to an embodiment of the present invention, FIG. 8 is a view showing control of an actuating unit when the pulsator rotates for stirring, and FIG. 9 is a view showing a scrubbing motion. FIG. 9 shows an example of a method of controlling the motor 22 to turn it on/off in accordance with time T, when the pulsator 10 rotates for stirring, in which the pulsator 10 rotates for stirring by repeating rotating during on-time TON and stopping during off-time TOFF.

The friction force F1 between the laundry and the inner pulsator 4, the gravity F2 due to a load, the friction force F3 between the extension 5*b* of the outer pulsator 5 and the inner tub 3, the centrifugal force F4 due to circumferential movement of the laundry, and the buoyancy F5 by the washing water may be important factors in various forces applied to laundry LA when the pulsator 10 rotates. The movement of the laundry is determined by the relationships of the forces and the relationships of the forces usually depend on the motion pattern of the pulsator 10.

The pulsator 10 can rotate alternately in two directions by repeating operating and stopping. For example, the pulsator 10 can operate clockwise CW, stop, and then operate counterclockwise CCW. In the following description, the time for which the pulsator 10 operates is defined as operation time or on-time and the time for which the pulsator 10 stops is defined as stop time of off-time.

The washing machine can control the operation pattern of the pulsator 10 in specific ways by controlling the on-time TON and the off-time TOFF in various ways. The movement of the laundry in the inner tub 3 depends on the operation pattern of the pulsator 10, and a scrubbing motion, a beating motion, and a turning motion to be described below are examples of the movement of laundry.

TABLE 1

| MOTION | Angular speed (RPM) | | ON/OFF Time(sec) | | Water level (L) |
|---|---|---|---|---|---|
| Scrubbing | RPM1 | 100~140 | T11 | 0.4~1.2 | L1 ⅓~½ |
| | | | T12 | 0.5~0.8 | |
| Beating | RPM2 | 110~150 | T21 | 1.0~1.4 | L2 ½~¾ |
| | | | T22 | 0.2~0.6 | |
| Turning | RPM3 | 90~140 | T31 | 1.0~1.4 | L3 ¾~1 |
| | | | T32 | 0.8~1.0 | |

Table 1 shows the angular speed (RPM), on-time (ON Time), off-time (OFF Time), and water level (L) of the pulsator 10 which are suitable for the scrubbing motion, the beating motion, and the turning motion. The angular speed (RPM) is the angular speed of the inner pulsator 4. The angular speed of the outer pulsator 5 follows the angular speed ratio of the inner pulsator 4 and the outer pulsator 5.

The washing machine can perform at least one of a scrubbing step for generating a scrubbing motion, a beating step for generating a beating motion, and a turning step for generating a turning motion. The motions are described in detail hereafter.

The scrubbing motion generates the same effect as scrubbing laundry with hands by smoothly providing friction between pieces of laundry in the inner tub 3.

The laundry LA on the extension 5*b* of the outer pulsator 5 receives the friction force F1 having a centripetal component due to contact with the pulsator 10. The magnitude of the friction force F1 would be influenced by the shape of the pulsator 10 and the contact area between the pulsator 10 and the laundry LA and the pulsator 10 of the washing machine according to an embodiment of the present invention can have a wider contact area with the laundry by means of the inner projections 41 at the rotational center.

In the scrubbing motion, the circulation direction of the laundry in the inner tub 3 is opposite to the water current generated centrifugally (toward A from B) by a centrifugal force generated in rotation of the pulsator 10 and the laundry is moved vertically too (from B to C at the center C of the inner tub 3 and from D to A at the edge of the inner tub 3) and turned over, such that this type of circulation is defined as an inverse toroidal rollover motion.

The inverse toroidal rollover motion is generated because the laundry LA is centripetally moved at the lower portion in the inner tub 3 and the laundry LB at the upper portion moves down and fills the space generated by the centripetal movement of the laundry LA, such that the pieces of laundry are continuously moved.

In particular, for the laundry LA at the joint of the extension 5*a* and the inner pulsator 4, the friction force F1 (friction force by the pulsator 10) needs to be enough to resist the friction force F3 (friction force between the laundry and the inner tub 3) and the force (or friction force) centrifugally holding the laundry LA by the centrifugal force F4. Since the relationships of the forces applied to the laundry LA are influenced by the angular speed of the pulsator 10, the angular speed of the pulsator 10 should be determined within an appropriate range in order to generate the inverse toroidal rollover motion.

It is preferable that appropriate range, that is, the range of the angular speed (RPM1) for the scrubbing motion is determined such that the resultant force applied to the laundry LA has a centripetal component and can prevent pieces of laundry from tangling in the inner tub 3. In particular, the lower limit of the angular speed RPM1 for the scrubbing motion should be determined such that the resultant force applied to the laundry LA has a centripetal component.

The upper limit of the angular speed RPM1 is in close connection with the degree of distribution in the inner tub 3. Since the pulsator 10 rotates at the lower portion in the inner tub 3, there is a difference between the movement speed of laundry (or the speed of water currents) at the lower portion and the movement speed of laundry (or the speed of water currents) at the upper portion in the inner tub 3, so when the angular speed of the pulsator 10 is too high, the speed difference of laundry at the upper portion and the lower portion in the inner tub 3 increases and the pieces of laundry are tangled.

In particular, in one-cycle rotation of the pulsator 10 (with one operation and one stop), the circumferential angular change of the laundry LA (hereafter, referred to as rotation angle) should be smaller than that of the pulsator 10. For example, when the pulsator 10 operates one time clockwise CW for the on-time T11, stops for the off-time T12, and then operates again one time counterclockwise CCW for the on-time T11, the laundry is also turned sequentially clockwise and counterclockwise, in which the laundry can keep turned by the inertia even during the off-time. When the laundry circumferentially moves too much, the vertical movement is relatively decreased, so it is required to limit the rotation angle of the laundry within a predetermined range. That is, in terms of operation control of the pulsator 10, it is required to set the angular speed of the pulsator 10 for the on-time, the length of the off-time T11, and the length of the off-Time T12 within appropriate ranges.

The angular speed RPM1 of the pulsator 10 for the on-time T11 should be larger than the angular speed of the laundry. The angular speed of the laundry is based on the same rotational direction as the pulsator 10. In this case, the laundry does not rotate simultaneously with the pulsator 10 and moves, having a relative speed to the pulsator 10. The laundry is moved mainly by a drag force between the laundry and the inner projections 41 of the pulsator 10.

It is preferable to set the upper limit of the angular speed RPM1 of the pulsator 10 for the on-time T11 in consideration of heat generated by the motor 22. In general, motor drivers called an IPM includes circuit elements that generate heat when a current is applied. Accordingly, the upper limit of the angular speed RPM1 should be determined within a range in which the temperature of the IPM does not increase over a predetermined allowable level. Considering those factors, it is preferable that the angular speed RPM1 of the pulsator 10 is 100 to 140 rpm.

The lower limit of the on-time T11 should be over a time enough for the pulsator 10 to rotate with a relative speed to the laundry and the upper limit should be shorter than the maximum time for which the relative speed between the laundry and the pulsator 10 can be maintained. That is, the length of the on-time T11 should be determined within a range in which the laundry does not rotate simultaneously with the pulsator 10, but rotates with a relative speed.

The movement of a rigid body generally follows the displacement of the source applying a force to it and the force is usually used to overcome the inertia of the rigid body in the early stage in which the force is applied to the rigid body from the source, so the motion of the rigid body and the motion of the source take a predetermined time to make balance. In this concern, when laundry is moved in the inner tub 3 by a drag force from the pulsator 10, the drag force from the pulsator 10 is mainly used to accelerate the stopped laundry in the early stage of the on-time T11 or used to change the movement direction of the laundry moved by the inertia during the off-time T12, so the laundry is attached to and moved with the pulsator 10 at the lower portion in the inner tub 3. Thereafter, when the pulsator 10 keeps rotating, the laundry starts rotating in the same direction as the pulsator 10 at any point of time, but since the angular speed of the pulsator 10 is larger than that of the laundry, a period where a relative motion is generated between the laundry and the pulsator 10 is generated. Another noticeable factor in the relative motion between the laundry and the pulsator 10 is the period where the rotational directions of the pulsator 10 and the laundry are opposite. This phenomenon is caused, when the pulsator 10 rotating in one direction stops and then rotates back in the opposite direction, that is, since the laundry keeps turned in the direction by the inertial even while the pulsator 10 stops, there is a period where the rotational directions of the laundry and the pulsator 10 are opposite, when the pulsator 10 rotates counterclockwise CCW at the next time.

The upper limit of the on-time T11 was considered within a range in which the period where the angular speed of the pulsator 10 is larger than the angular speed of the laundry does not disappear. That is, when the on-time T11 is continued, the laundry may be turned at the same speed as or even faster than the angular speed of the pulsator 10 by the water vortex, such that it turns the laundry too fast and interferes with the inverse toroidal rollover motion. Considering those factors, it is preferable that the on-time T11 is 0.4 to 1.2 seconds.

The length of the off-time T12 is in connection with the movement time of the laundry due to the inertia. The laundry is turned by the inertial during the off-time T12, so the smaller the length of the off-time T12, the faster the inertia of the laundry is overcome. For example, when the pulsator 10 rotates clockwise for the on-time T11, stops for the off-time T12, and then rotates counterclockwise for the on-time T11, the laundry is turned clockwise by the inertia in the period of off-time T12, so preferably, the movement of the laundry should be stopped by the pulsator 10, when the next on-time T11 is reached while the laundry is turned by the inertia. Accordingly, the length of the off-time T12 needs to be as small as possible, not over the time at which the laundry turned by the inertia is naturally stopped. Considering those factors, it is preferable that the off-time T12 is 0.5 to 0.8 seconds.

The scrubbing motion is influenced by the water level or the amount of laundry too. Too low water level interferes with vertical movement of the laundry, and two low water level increases the buoyancy F5, so the friction force F1 between the laundry and the pulsator 10 decreases, and accordingly, the laundry cannot smoothly move centripetally. It is preferable that the water level is ⅓ to ½ of the height of the laundry loaded in the inner tub 3.

Hereinafter, the beating motion is described.

The beating motion is performed such that the inner projections 41 of the pulsator 10 continuously beat against laundry but the laundry is almost not moved, in which the laundry is just vibrated or reciprocated within a predetermined range. Accordingly, it is possible to achieve an effect like hitting or beating the laundry in washing.

In the beating step, the angular speed of the pulsator 10 should be controlled to be larger than the angular speed of the laundry. However, the lower the water level, the more the turning of the laundry is influenced by the drag force applied to the laundry from the pulsator 10, so the movement of the laundry follows the rotation of the pulsator 10. For example, the laundry is turned on the inner projections 41 of the pulsator 10. In this case, since the pulsator 10 does not beat against the laundry in rotation, a predetermined level of buoyancy is applied to the laundry, so it is required to reduce the load on the pulsator 10. However, when the water level is too high, the buoyancy applied to the laundry increases and the load on the pulsator 10 excessively reduces, and accordingly, a relative speed between the laundry and the pulsator 10 is not generated, that is, the inner projections 41 of the pulsator 10 cannot beat against the laundry. Accordingly, the water level needs to be controlled at an appropriate level and preferably covers ½ to ¾ of the laundry loaded in the inner tub 3.

In particular, as compared with the scrubbing step, it is preferable that the angular speed of the pulsator 10 is controlled to be faster (RPM2>RPM1) and the water level is also controlled to be higher (L2>L1). The on-time T21 should be set within a predetermined range, that is, the lower limit should be lager than the minimum time for which the pulsator 10 can rotates, beating against the laundry, and the upper limit should be smaller than the maximum time considering an increase in temperature of the IPM.

Similar to the scrubbing step, the shorter the off-time T22, the easier the relative speed between the laundry and the pulsator is generated, which is advantageous for achieving the beating motion. This is because the shorter the off-time T22, the faster the inertial of the laundry is removed. The on-time T21 and the off-time T22 may depend on the amount of laundry. This is because the load on the pulsator 10 depends on the amount of laundry. It is preferable that the larger the amount of laundry, the longer the on-time T21 is set. This is because more time is needed for the pulsator 10 to beat against and pass the laundry, against the inertial of the laundry. It is preferable that the larger the amount of the laundry, the shorter the off-time T22 is set. Since the larger the amount of the laundry, the larger the inertia, it is required to make the pulsator 10 quickly perform the next operation in order to remove the inertia of the laundry. The on-time T21 and the off-time T22 may depend on the water level. This is because the magnitude of the buoyancy applied to the laundry depends on the water level. It is preferable that the lower the water level, the longer the on-time T21 is set. The lower the water level, the more the load applied to the pulsator 10 increases, and accordingly, the pulsator 10 and the laundry have difficulty in moving with a relative speed, so the pulsator 10 needs to be operated for a longer time.

It is preferable that the higher the water level, the shorter the off-time T22 is set. This is because it is required to make the pulsator 10 quickly perform the next operation in order to prevent movement of the laundry due to the inertia, because the higher the water level, the more the laundry circumferentially moves due to the inertia under the influence of the water vortex.

The angular speed RPM2, the on-time T21, the off-time T22, and the water level L2 described in Table 1 are examples set in consideration of those various factors, and according to tests by the applicant(s), the beating motion was smoothly performed, when the angular speed was 110 to 150 rpm, the on-time was 1.0 to 1.4 seconds, the off-time was 0.2 to 0.4 seconds, and the water level was ½ to ¾ of the height of the laundry loaded in the inner tub 3.

Hereinafter, the turning motion is described.

The turning motion moves laundry at a turning angle over the rotation angle of the pulsator 10. The turning motion smoothly turns the laundry in the same direction as the pulsator 10, such that the laundry is not tangled and is washed by friction with the inner tub 3 while it turns.

In the turning motion, the lower limit of the angular speed RPM3 of the pulsator 10 during the on-time is the minimum speed at which the pulsator 10 can move the laundry. That is, the pulsator 10 does not beat against the laundry, passing it, unlike the beating motion, but the laundry should be pushed and moved by the drag force from the pulsator 10.

It is preferable to set the upper limit of the angular speed RPM3 of the pulsator 10 in consideration of heat generated by the motor 22. The upper limit may be determined within a range in which the temperature of the IPM does not increase over a predetermined allowable level.

The on-time T31 should be set within a predetermined range, that is, the lower limit of the on-time T31 should be longer than the minimum time that the laundry takes to start moving simultaneously with the pulsator 10 and the upper limit should be shorter than the minimum time considering an increase in temperature of the IPM.

It is preferable that the off-time T32 is set longer than the time that the laundry turned by the inertia takes to stop. The off-time t32 may be set longer, as compared with in the beating motion. When the off-time T32 is short, the pulsator 10 performs the next operation, before the inertia of the laundry is removed, such that the beating motion may be performed. Accordingly, it is preferable that the off-time T32 is sufficiently long so that the laundry moved by the inertia under the influence of the previous operation (CW) of the pulsator 10 can stop, before the pulsator 10 performs the next operation (CCW). It is preferable that the larger the amount of laundry, the longer the on-time T31 is set. This is because the larger the amount of the laundry, the more the laundry takes time to be accelerated. It is preferable that the larger the amount of the laundry, the longer the off-time T32 is set. Since when the amount of the laundry is large, the inertia increases accordingly, it takes the laundry more time to stop. The on-time T31 and the off-time T32 may depend on the water level. This is because the magnitude of the buoyancy applied to the laundry depends on the water level.

It is preferable that the lower the water level, the longer the on-time T31 is set. When the water level is low, the buoyancy applied to the laundry is small and the laundry absorbs water, as time passes (hereafter, the amount of water absorbed by the laundry is referred to as "absorbed-water amount"), such that the load on the pulsator 10 increases, and accordingly, it is required to operate the pulsator 10 for a longer time, before the turning motion is developed. Further, the load on the pulsator 10 is in close connection with power consumption and an increase in temperature of the IPM. Accordingly, it is preferable to keep the water level over an appropriate level.

It is preferable that the higher the water level, the longer the off-time T32 is set. This is because as the higher the water level, the more the water vortex is developed, such that it takes the laundry turned by the inertia more time to stop.

The angular speed RPM2, the on-time T31, the off-time T32, and the water level L3 described in Table 1 are examples set in consideration of those various factors, and according to tests by the applicant(s), the beating motion was smoothly performed, when the angular speed was 90 to 140 rpm, the on-time was 1.0 to 1.4 seconds, the off-time was 0.8 to 1.0 seconds, and the water level was ¾ to 1 of the height of the laundry loaded in the inner tub 3.

The angular speed RPM, the on-time (On Time)/off-time (OFF/Time), the water level L, and the amount of laundry not shown in Table 1 though, which are the variables in the steps shown in Table 1 are also in connection with each other. That is, the variables should be generally considered to define the motions. Accordingly, even if the pulsator 10 rotates within the same angular speed range, different motions may be implemented, depending on the values set for other variables. For example, both of the scrubbing motion and the beating motion can be implemented in the period where the angular speed of the pulsator 10 is 110 to 140 rpm. However, which motion will be determined in the same angular speed range would be determined by the on-time, the off-time, the water level, and/or the amount of laundry. In detail, if the rotation of the pulsator 10 is controlled at 120 rpm in both of the scrubbing motion and the beating motion, the scrubbing motion may be performed, when the on-time is 0.4 seconds, and the beating motion may be performed, when the on-time is 1.4 seconds. Further, even if the on-time is 1.0 seconds (within the range of on-time set in the scrubbing step and the range of on-time set in the beating step), the motion may be determined again in accordance with the set value of the off-time. Further, when the water level or the amount of laundry is also considered in this case, different motions may be performed by the values of the other variables, even if the values of some of the variables in Table 1 are the same. Accordingly, it should be noted that the values of the variables in Table 1 show the range in which the corresponding motions are achieved, and it is required to appropriately select again the values of the variables within the range, corresponding to the definition of the motions, in order to obtain desired motions.

The scrubbing step is a step for implementing the scrubbing motion, in which the pulsator 10 is rotated alternately in two directions and is controlled to repeat operating and stopping within the range in which the laundry in the inner tub 3 can be moved centripetally by the friction force between the pulsator 10 and the laundry.

The beating step is a step for implementing the beating motion, in which the pulsator 10 is rotated alternately in two directions and is controlled at a larger angular speed (RPM2>RPM1) for a longer time (T21>T21), in comparison to the scrubbing step.

In the scrubbing step, a detergent is uniformly dissolved and washing ability like scrubbing laundry in washing can be achieved by the friction among pieces of laundry. Thereafter, in the beating step, dirt is actively separated from laundry by shock applied to the laundry from the pulsator 10, so the washing ability is further improved.

The turning step may be further performed, after the beating step. The laundry is smoothly moved in the inner tub 3 and keeps washed by the friction force between the laundry and the inner tub 3, especially, the side 32. The turning step can minimize damage to the laundry in comparison to the scrubbing step and the beating step and has an effect of smoothing out wrinkles. In particular, it is also important to minimize damage to laundry, in addition to improving the washing ability, in washing of the laundry. However, since it becomes a factor of increasing damage to laundry to extend the scrubbing step or the beating step in order to improve the washing ability, it is possible to minimize damage to the laundry and keep the washing ability at a predetermined level, by performing the turning step, after a detergent is sufficiently applied to the laundry and a sufficient physical force is applied by the friction among the pieces of laundry and the force from the pulsator 10.

The scrubbing motion, the beating motion, and the turning motion can be determined in accordance with the angular speed of the pulsator, the on-time, the off-time, the water level, and the amount of laundry and the ranges of the values described in Table 1 can also be applied to a graph, so the description of them follows the above description.

Figure 10:
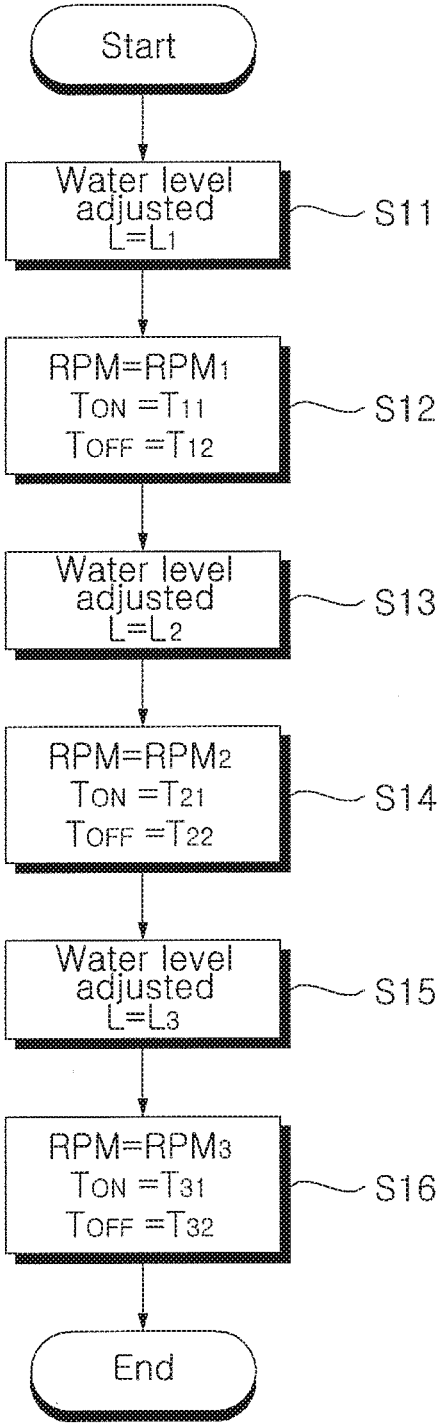
FIG. 10 is a flowchart illustrating a method of controlling a washing machine according to an embodiment of the present invention.

FIG. 10 is a flowchart illustrating a method of controlling a washing machine according to an embodiment of the present invention. Referring to FIG. 10, a water level adjusting step (S11), which adjusts a water level to be suitable for performing the scrubbing motion, makes the water level in the inner tub 3 be at L1 by controlling at least one of a water supplying unit and a water discharging unit. The water supplying unit is a device adjusting the amount of water flowing into the washing machine from the outside. The water supplying unit adjusts inflow of water. The water discharging unit is a device discharging the water in the washing machine to the outside.

A scrubbing step (S12) performs the scrubbing motion, in which the angular speed RPM of the pulsator 10, the on-time TON, and the off-time TOFF are the same as RPM1, T11, and T12 in Table 1, and the detailed description is replaced by those described above about the scrubbing motion.

A water level adjusting step (S13), which adjusts a water level to be suitable for performing the beating motion, makes the water level in the inner tub 3 be at L2 by controlling at least one of the water supplying unit and the water discharging unit. It is preferable that the water level L2 in the inner tub 3 is higher than that in the scrubbing step (S12) (L2>L1).

A beating step (S12) performs the beating motion, in which the angular speed RPM of the pulsator 10, the on-time TON, and the off-time TOFF are the same as RPM2, T21, and T22 in Table 1, and the detailed description is replaced by those described above about the beating motion.

A water level adjusting step (S15), which adjusts a water level to be suitable for performing the turning motion, makes the water level in the inner tub 3 be at L3 by controlling at least one of the water supplying unit and the water discharging unit. It is preferable that the water level L3 in the inner tub 3 is higher than that in the beating step (S13) (L3>L3).

A turning step (S16) performs the turning motion, in which the angular speed RPM of the pulsator 10, the on-time TON, and the off-time TOFF are the same as RPM3, T31, and T32 in Table 1, and the detailed description is replaced by those described above about the turning motion.

The pulsator 10 includes the inner pulsator 4 and the outer pulsator 5 which rotate at different angular speeds. It is preferable that the rotational directions of the inner pulsator 4 and the outer pulsator 5 are opposite to each other.

The inner pulsator 4 and the outer pulsator 5 may rotate at different angular speeds. The outer pulsator 5 may rotate at an angular speed lower than the inner pulsator 4, and preferably, the angular speed ratio between the inner pulsator 4 and the outer pulsator 5 may be 2:1 to 3:1.

The washing machine with the inner pulsator 4 and the outer pulsator 5 rotating at different angular speeds can achieve more active centripetal movement of laundry by increasing the friction by the pulsator 10.

When the inner pulsator 4 and the outer pulsator 5 rotate in opposite directions, laundry is turned mainly by the inner pulsator 4 having a higher angular speed, but the outer pulsator 5 attenuates a predetermined amount of inertia due to the turning, such that the beating motion can be more actively achieved.

Further, even though the rotation of the outer pulsator 5 somewhat interferes with the turning motion, the turning of the laundry is influenced mainly by the rotation of the inner pulsator 4, considering the water vortex generated by the pulsator 10 is centrifugally generated with the rotation, such that the turning motion can also be achieved.

The operation of the washing machine having the configuration is described hereafter.

First, the motor 22 in the washing machine can be operated in a washing cycle. As the motor 22 is operated, the rotary shaft 23 is rotated and the sun gear 70 is rotated with the rotary shaft 23. When the sun gear 70 rotates, the inner pulsator 4 rotates with the sun gear 70 in the same rotational direction as the rotational direction of the sun gear 70 and the planetary gears 80 can be rotated by the sun gear 70 between the sun gear 70 and the ring gear 90. The planetary gears 80 rotate about the support shafts 65 fixed to the fixing hub 60, between the fixing hub 60 and the planetary gear holder 86. The planetary gears 80 rotates about the support shafts 65, not revolving around the sun gear 70, in which the sun gear 90 rotates at a rotational speed lower than the sun gear 70, in the opposite direction to that of the sun gear 70. As the ring gear 90 rotates, the gear box 100 rotates with the ring gear 90 and the outer pulsator 5 rotates with the gear box 100.

In the washing machine, the inner pulsator 4 and the outer pulsator 5 rotate at different rotational speeds in opposite directions and more three-dimensional water vortex is generated in the inner tub 3, than when one pulsator 10 rotates. That is, the washing water at the center in the inner tub 3 can generate water vortex by being moved mainly by the inner pulsator 4 and the washing water around the inner side of the inner tub 3 can generate water vortex in the opposite direction to the washing water at the center in the inner tub 3 by being moved by the outer pulsator 5. Two water vortexes can be generated at different rotational speeds in different directions in the inner tub 3 and more complicated three-dimensional water currents can be generated, as compared with when one pulsator 01 is disposed in the inner tub 3.

Figure 11:
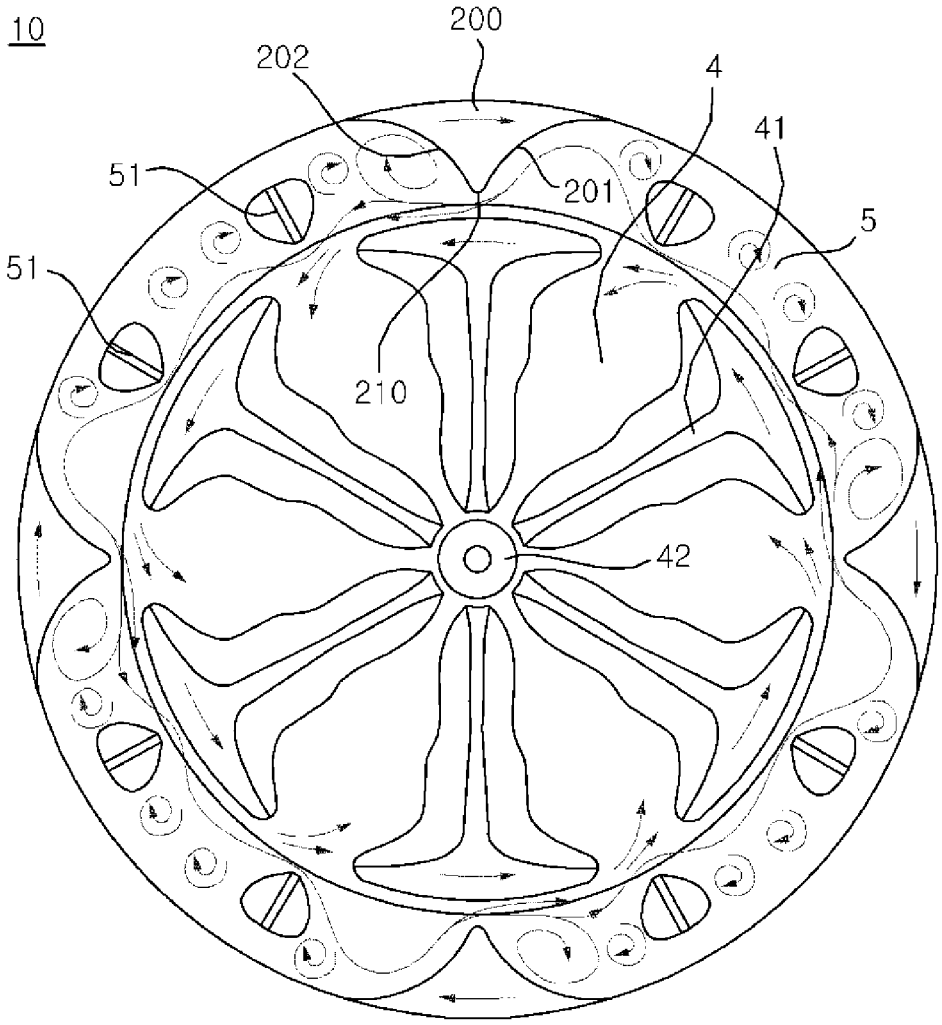
FIG. 11 is a view schematically showing the flow of washing water in an inner tub according to an embodiment of the present invention.

FIG. 11 is a view schematically showing the flow of washing water in an inner tub according to an embodiment of the present invention.

Referring to FIG. 11, the washing water guided by the first inclined surface 201 is distributed over the edge 210. Some of the washing water flows to the inner projections 41 and the other flows back to the side wall 5*a* by the centrifugal force. The washing water flowing to the side wall 5*a* makes a vortex by means of the second inclined surface 202. Since the first inclined surface 201 and the second inclined surface 202 are curved, they reduce flow resistance of the washing water and accelerate generation of the vortex. The vortex 202 formed by the second inclined surface 202 gradually decreases in magnitude, as the outer pulsator 5 rotates. A vortex may be generated again by the outer projection 51. The rotational directions of outer pulsator 5 and the inner pulsator 4 may be opposite to each other. Accordingly, the guide 200 may turn in the opposite direction to the rotational direction of the washing water. The guide 200 forms a vortex or supplies washing water to the center of the inner tub 3 by hitting against the washing water, such that the washing water can uniformly flow throughout the inner tub 3. Due to the flow of the washing water, the scrubbing motion, the beating motion, and the turning motion are more easily generated, thereby increasing the washing ability.

Figure 12:
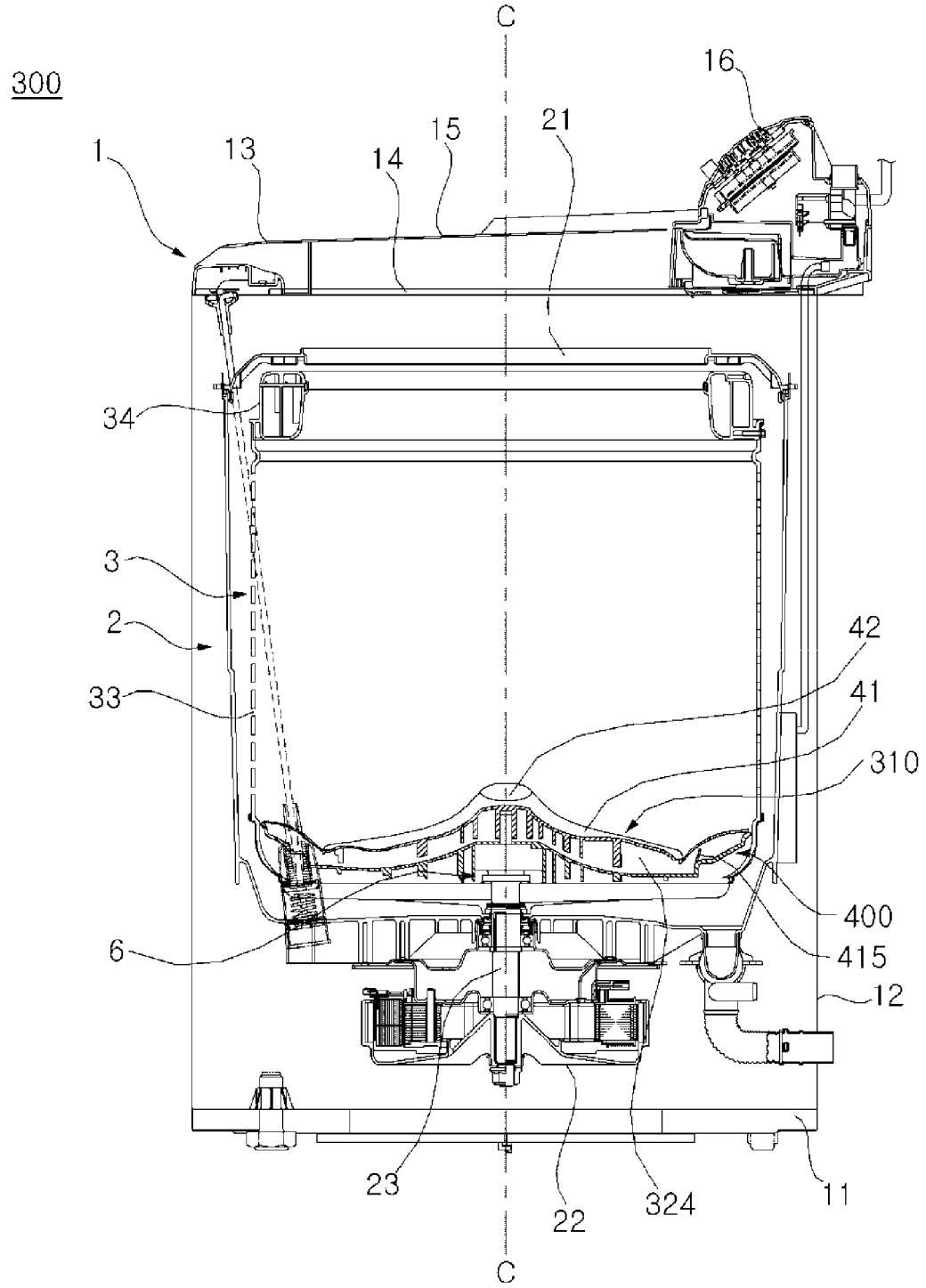
FIG. 12 is a vertical cross-sectional view showing a washing machine according to another embodiment of the present invention.
Figure 13:
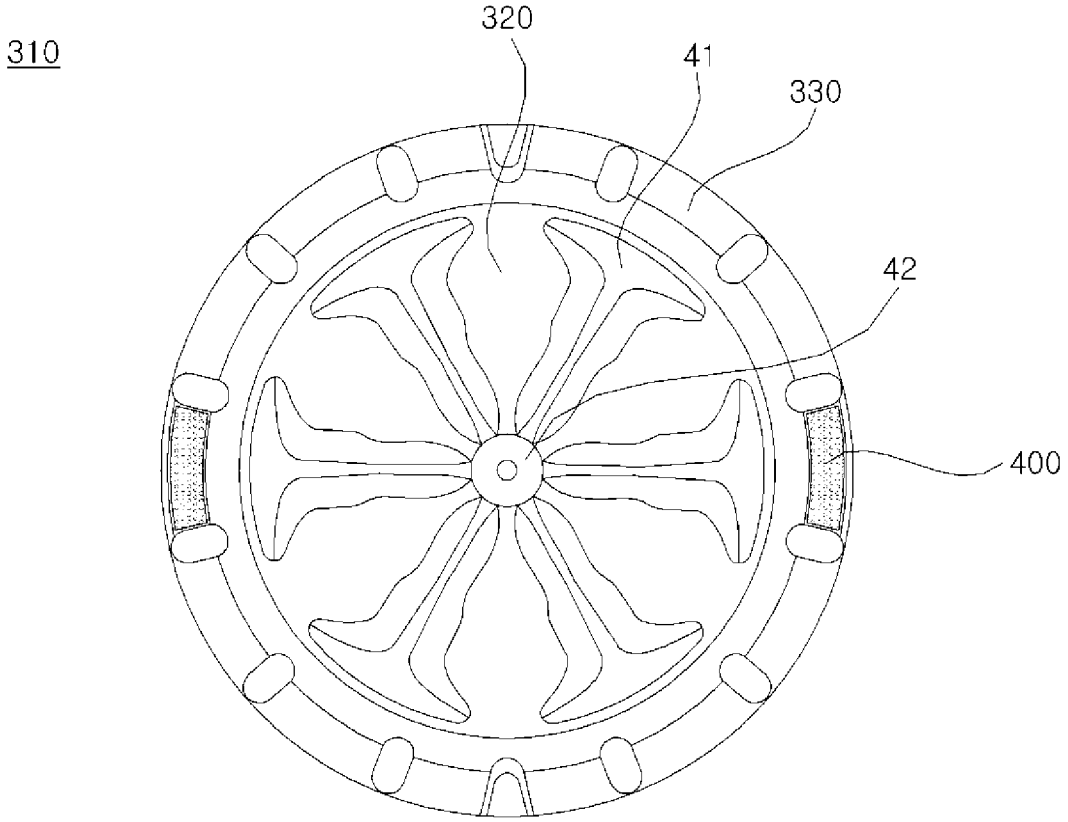
FIG. 13 is a plan view showing a pulsator according to another embodiment of the present invention.
Figure 14:
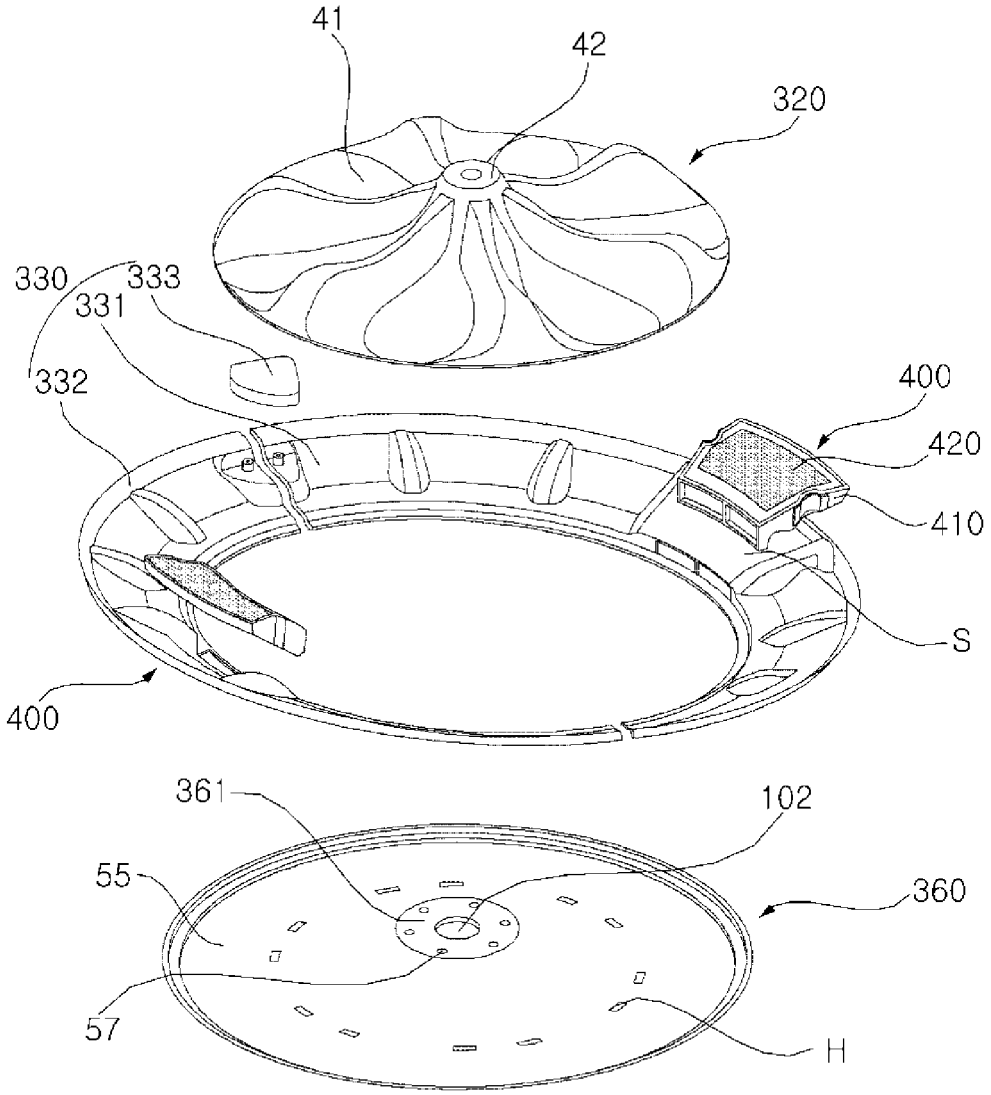
FIG. 14 is an exploded perspective view showing the pulsator according to another embodiment of the present invention.
Figure 15:
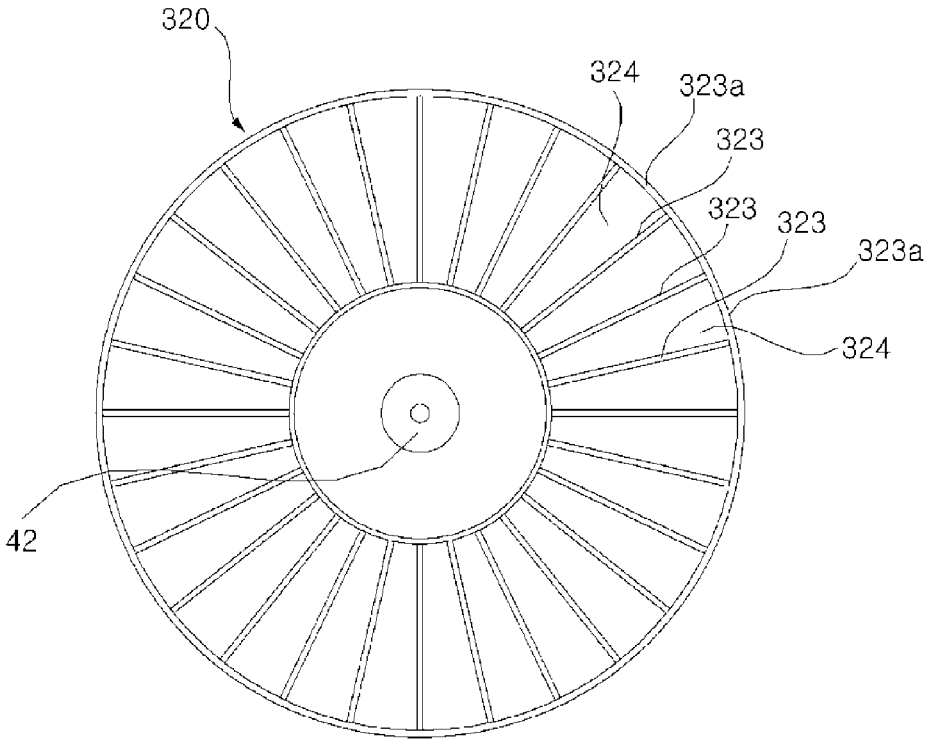
FIG. 15 is a bottom view showing an inner pulsator according to another embodiment of the present invention.
Figure 16:
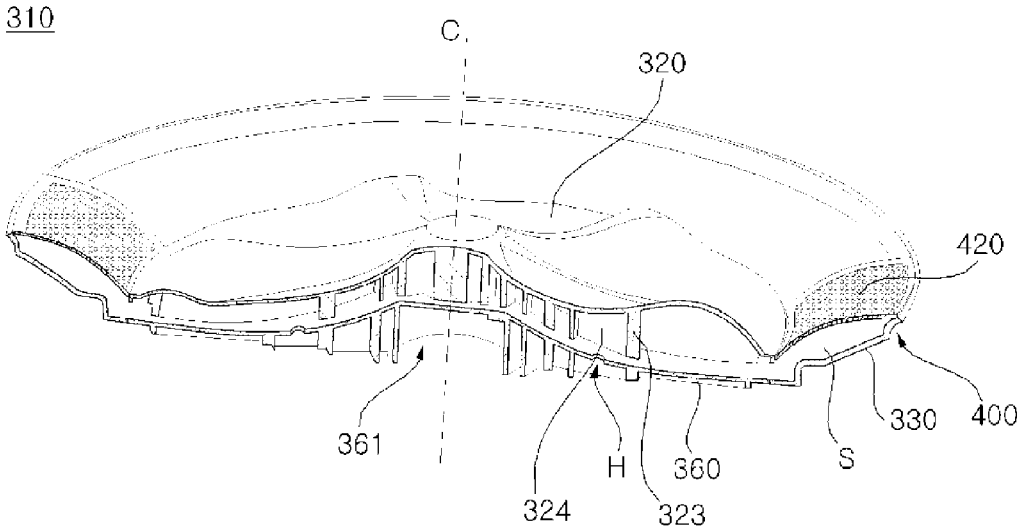
FIG. 16 is a cross-sectional showing the pulsator according to another embodiment of the present invention.

FIG. 12 is a vertical cross-sectional view showing a washing machine according to another embodiment of the present invention, FIG. 13 is a plan view showing a pulsator according to another embodiment of the present invention, FIG. 14 is an exploded perspective view showing the pulsator according to another embodiment of the present invention, FIG. 15 is a bottom view showing an inner pulsator according to another embodiment of the present invention, and FIG. 16 is a cross-sectional showing the pulsator according to another embodiment of the present invention.

Referring to FIGS. 12 to 15, the washing machine 300 according to another embodiment of the present invention includes an inner tub 3 receiving laundry, a pulsator 310 having a circulation channel through which washing water in the inner tub 3 flows, and filters 400 mounted on the pulsator 310 to filter washing water flowing through the circulation channel 324. The other configuration and operation of the washing water 300 according to the present embodiment may be same as or similar to those of the first embodiment of the present invention, except for the pulsator 310 and the filters 400, the same reference numerals are used, and the detailed description is not provided.

The pulsator 310 may be rotatably disposed on the bottom inside the inner tub 3. The pulsator 310 can be rotated by the rotary shaft 23 of the motor 22. The outer tub 2 may be equipped with the motor 22 rotating the pulsator 310.

The pulsator 310 may include an inner pulsator 320 and/or an outer pulsator 330. The pulsator 310 may further include a base pulsator 360.

The motor 22 generates a force for rotating the inner pulsator 320 and/or the outer pulsator 330 and/or the inner tub 3.

The inner pulsator 320 may be rotatably disposed on the bottom inside the inner tub 3 and can generate vortex of washing water by rotating. The inner pulsator 320 may have at least one inner projection 41. The inner projection 41 may protrude up on the inner pulsator 320. The inner pulsator 320 may have a planetary gear set-coupling portion 42 at the center to which the planetary gear set 6 is connected. The inner projection 41, which guides water vortex around the inner pulsator 320, may be elongated in the radial direction of the inner pulsator 320. The inner projection 41 may be elongated from the planetary gear set-coupling portion 42 to the edge of the inner pulsator 320. A plurality of inner projections 41 may be circumferentially arranged. The inner ends of inner projections 41 may be connected with the planetary gear set-coupling portion 42.

The outer pulsator 330 may be rotatably disposed on the bottom inside the inner tub 3 and can generate vortex of washing water by rotating. The outer pulsator 330 can rotate with the inner pulsator 320 at a rotation speed different from the inner pulsator 320.

The pulsator 310 is disposed on the bottom inside the inner tub 3 and turns washing water. The washing water generates water vortex by means of the pulsator 310.

The circulation channel 324 is formed at the pulsator 310. The circulation channel 324 is formed in the pulsator 310. The circulation channel 324 is formed by blades 323 to be described below. Washing water is sent into and discharged out of the circulation channel 324 by rotation of the pulsator 310. A plurality of circulation channels 324 may be formed. The washing machine 300 may include the blades 323 vertically disposed on the pulsator 310 so that the circulation channels 324 are elongated away from the rotational center. The blades 323 can form the circulation channels 324. A plurality of blades 323 may be provided and the circulation channels 324 can be formed between the blades. The blades can generate water currents without coming in direct contact with laundry. The pulsator 310 may have a plurality of exits 323*a*, through which washing water is discharged, between the blades 323. A plurality of circulation channels 324 may be formed between the blades 323. The circulation channels 324 may be circumferentially arranged. The circulation channels 324 may be spirally formed.

The filters 400 may be mounted on the pulsator 310. The filters 400 rotate with the pulsator 310. The filters 400 may be disposed in the circulation channels 324 or may communicate with the circulation channels 324, at the ends of the circulation channels 324. The filters 400 remove dirt m in washing water. The circulation channels 324 and the filters 400 can rotate together. The circulation channels 324 and the filters 400 may have different rotation directions or different rotational speeds. The rotational directions and the rotation speeds may depend on the planetary gear set 6. The planetary gear set 6 may be the same as or similar to that in the first embodiment, so the detailed description is not provided. The washing water flowing in the circulation channel 324 can be filtered by the filter 400 and dirt m in the washing water put in the inner tub 3 is removed, such that laundry can be more cleaned.

The filters 400 may have a size corresponding to some of the circulation channels 324. When the outer pulsator 330 rotates, the circulation channels 324 that communicate with the filters 400 may be variable. The inner pulsator 320 and the outer pulsator 330 may rotate in different directions. The inner pulsator 320 and the outer pulsator 330 may have different speeds. Accordingly, when the inner pulsator 320 rotates, the circulation channels 324 can sequentially communicate with the filters 400.

The filters 400 are arranged to face the exits 323*a* to filter the washing water discharged from the exits 323*a* and change the exits 323*a* to be connected by rotation of the pulsator 310. The pulsator 310 may be composed of the inner pulsator 320 and the outer pulsator 330, the blades 323 and the exits 323*a* are formed on the inner pulsator 320, and the filters 400 may be disposed on the outer pulsator 330. The filters 400 are disposed in the exits 323*a*. The exits 323*a* and/or the filters 400 make relative motions so that the portions that communicate with each other are changed. When the filters 400 and the pulsator 320 rotate together, the communicating positions can be continuously changed.

The washing machine 300 may further include the outer tub 2 disposed outside the inner tub 3 and the pulsator 310 has inlet holes H so that the washing water in the outer tub 2 can flow into the circulation channels 324.

The pulsator 310 is rotatably disposed in the inner tub 3. The motor 22 rotating the pulsator 310 is disposed under the outer tub 2. The rotary shaft 23 of the motor 22 is connected with the planetary gear set 6 through the bottom of the outer tub 2. The inlet holes H are formed through the pulsator 310. The washing water in the outer tub 2 flows to the circulation channels 324 in the pulsator 310. The washing water flows to the circulation channel 324, when the pulsator 310 rotates. The inlet holes H may be formed in the pulsator 310. The inlet holes H are formed at the lower portion of the pulsator 310 not to be blocked by laundry. The inlet holes H may be formed at the base pulsator 360 to be described below. As the pulsator 310 rotates, the washing water is pushed in the circumferential direction of the pulsator 310 by a centrifugal force or inertia. The space created when the washing water is pushed is filled with washing water flowing inside through the inlet holes H. Accordingly, washing water keeps circulating through the circulation channels 324.

The pulsator 310 may include the inner pulsator 320 having the circulation channels 324 and the outer pulsator 330 having the same rotational center axis C as the inner pulsator 320 and mounted with the filters 400. The pulsator 310 may further include a base pulsator 360 connected with the outer pulsator 330.

The configuration and operation of the inner pulsator 320 may be the same as or similar to the inner pulsator of the first embodiment of the present invention, except that the circulation channels 324 are formed, and the detailed description is not provided. The circulation channels 324 in the inner pulsator 320 can communicate with the filters 400.

The outer pulsator 330 may be formed substantially in a ring shape and the inner pulsator 320 may be formed substantially in a disc shape and positioned inside the outer pulsator 330. The outer pulsator 330, as shown in FIG. 14, may include a first outer pulsator 331 and a second outer pulsator 332. The first outer pulsator 331 and the second outer pulsator 332 may symmetric to each other. The first outer pulsator 331 and the second outer pulsator 332 may have the same shapes at the ends. The first outer pulsator 331 and the second outer pulsator 332 may be fastened to each other by a fixing member 333. The configuration and operation of the inner pulsator 320 may be the same as or similar to those of the outer pulsator of the first embodiment of the present invention, except for the filters 400.

The base pulsator 360 may be disposed under the inner pulsator 320. Inlet holes H are formed through the base pulsator 360. The washing water in the outer tub 2 flows into the circulation channels 324 through the inlet holes H. The base pulsator 360 may be connected and rotated with the planetary gear set 6. The configuration and operation of the base pulsator 360 may be the same as or similar to those of the base pulsator of the first embodiment of the present invention, except for the inlet holes H.

The filter 400 may be formed in a ring shape, but may be divided to for easy attachment and detachment. The filter 400 may communicate with the circulation channel 324. As the pulsator 310 rotates, the washing water in the inner tub 3 can keep flowing into the pulsator 310, and the washing water can keep filtered while the pulsator 310 rotates.

FIGS. 17A and 17B are an exploded perspective view of a pulsator and a filter according to another embodiment of the present invention and a cross-sectional view showing the assembly of them, respectively. FIG. 17A shows an example when the filter 400 is attached/detached to/from the outer pulsator 330 and FIG. 17B is a cross-sectional view when the filter 400 is mounted on the outer pulsator 330. FIGS. 18A and 18B show various ways of opening/closing the filter according to an embodiment of the present invention. FIG. 19 is a view showing dirt and washing water flowing in the pulsator according to an embodiment of the present invention.

Figure 17:
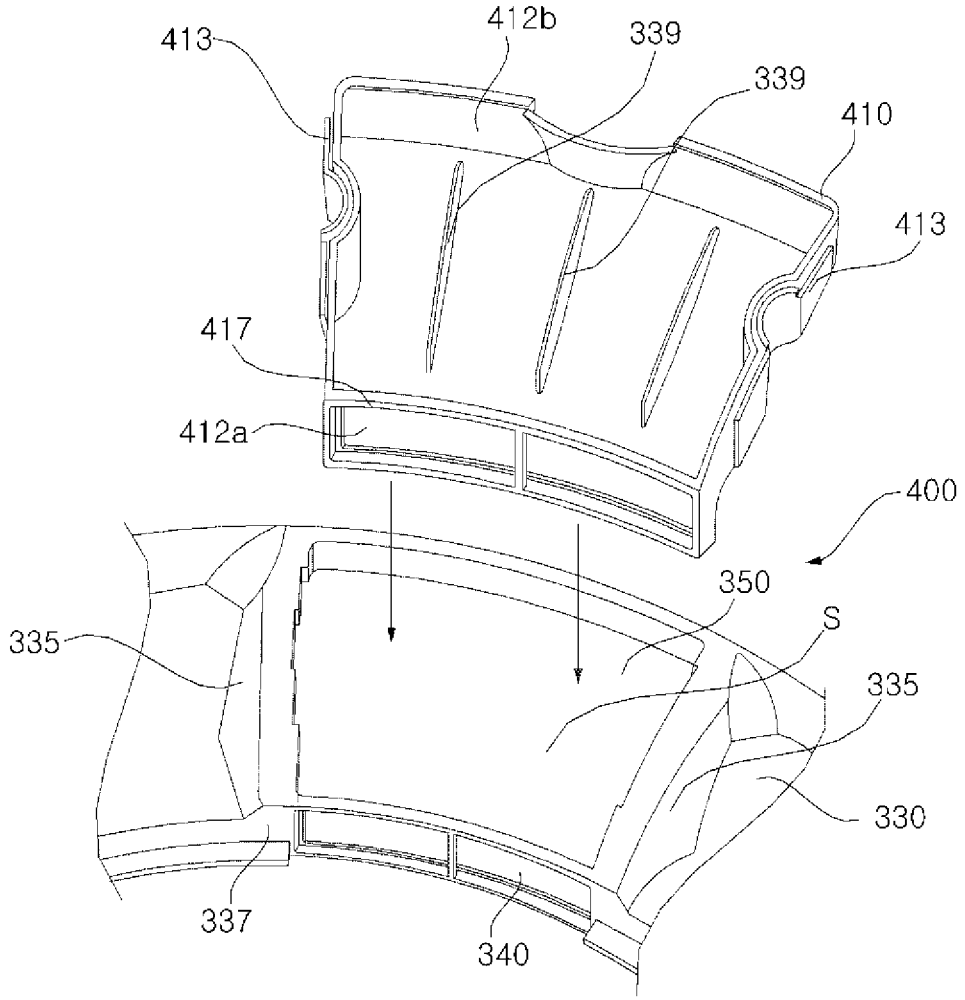
FIGS. 17A and 17B are an exploded perspective view of a pulsator and a filter according to another embodiment of the present invention and a cross-sectional view showing the assembly of them, respectively.
Figure 17:
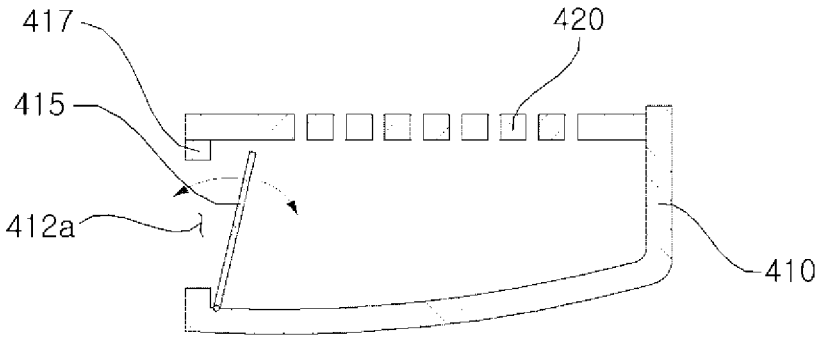
Figure 18:
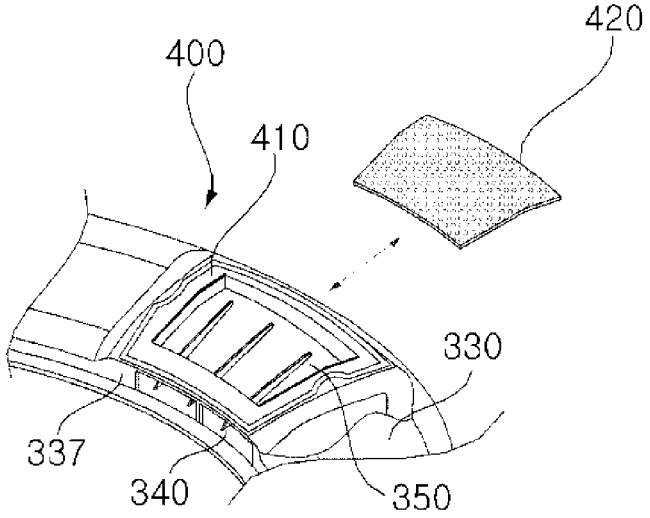
FIG. 18 is a view showing the way of opening/closing the filter according to another embodiment of the present invention.
Figure 18:
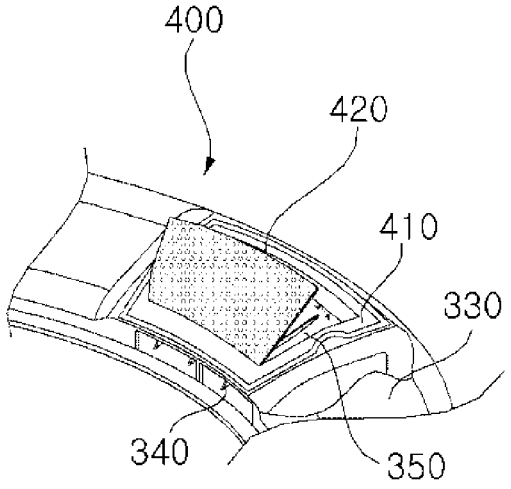
Figure 19:
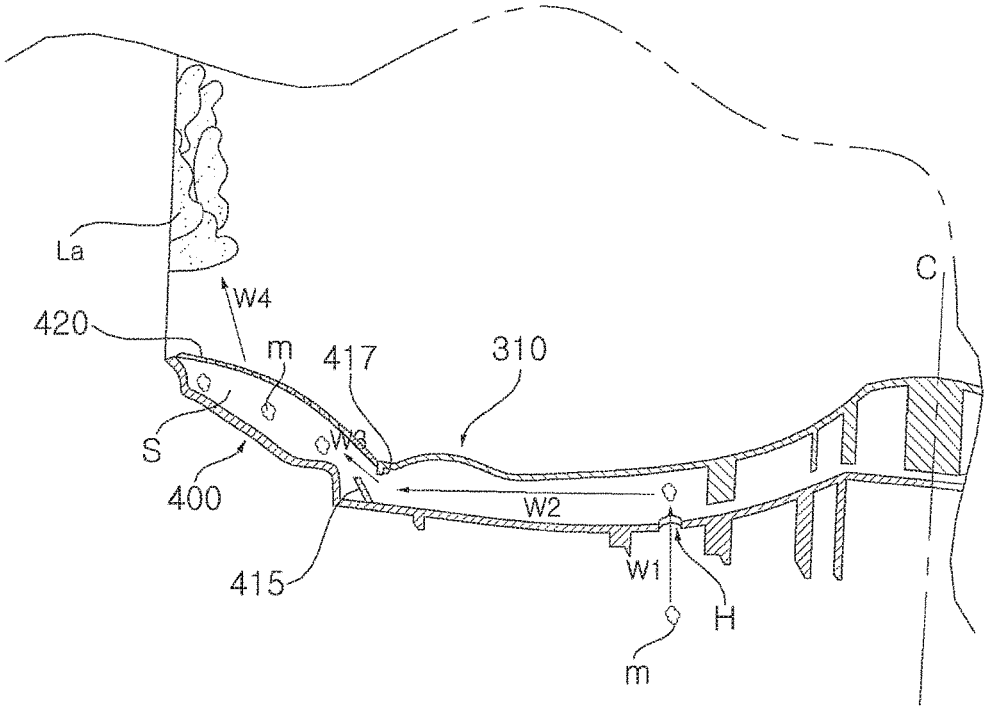
FIG. 19 is a view showing dirt and washing water flowing in the pulsator according to another embodiment of the present invention.

Referring to FIGS. 17 to 19, a collection space S where dirt m filtered by the filter 400 is collected may be formed in the pulsator 310. An inner tub-communicating portion 350 that enables the collection space S and the inner tub 3 to communicate with each other may be formed in the pulsator 310. A circulation channel-communicating portion 340 that enables the collection space S and the communication channel 324 to communicate with each other may be formed in the pulsator 310. The collection space S may be formed in the outer pulsator 330 and the inner tub-communicating portion 350 and the circulation channel-communicating portion 340 may be formed in the outer pulsator 330.

The inner tub-communicating portion 350 may be formed at the upper portion of the pulsator 310. The washing water discharged from the inner tub-communicating portion 350 flows to the inner tub 3. The inner tub-communicating portion 350 may be open upward over the collection space S.

The outer pulsator 330 may have a rim 337 covering the edge of the inner pulsator 320 and the circulation channel-communicating portion 340 that is open to communicate with the circulation channel 324 may be formed at the rim 337. The circulation channel-communicating portion 340 may be open to face the circulation channel 324. The circulation channel-communicating portion 340 may be open to a side facing the circulation channel 324 in the collection space S.

The filter 400 includes a housing 410 disposed in the collection space S. The housing 410 may have a circulation channel opening 412*a* that communicates with the circulation channel-communicating portion 340 and an inner tub opening 412*b* that communicates with the inner tub-communication portion 350.

The housing 410 may be inserted in the collection space S. The dirt m flowing in the collection space S may be received in the housing 410. The housing 410 may be fixed to the pulsator 310 to be positioned in the collection space S. The inner tub opening 412*b* is formed at the top of the housing 410. The circulation channel opening 412*b* is formed at the side of the housing 410.

The pulsator 310 has separators 335 defining the collection space S and the housing 410 may have mounting portions 413 elastically being contact with the separators 335 to prevent separation from the pulsator 310. The mounting portions 413 may be integrally formed with the housing 410.

The filter 400 may further include a filtering portion 420 that filters dirt. The filtering portion 420 may be mounted in the housing 410 or the pulsator 310. The filtering portion 420 can close the inner tub-communication portion 350 or the inner tub opening 412*b*.

The filtering portion 420 may be disposed in any one of the pulsator 330 and the housing 410 to open/close the inner tub-communication portion 350 and the inner tub opening 412*b*. The filtering portion 420, as shown in FIG. 18A, may be slidably disposed in any one of the pulsator 330 and the housing 410 to open/close them, and may be hinged to any one of the pulsator 330 and the housing 410 to open/close them, as shown in FIG. 18B.

The washing machine 300 further includes a flow stopper 415 disposed in the circulation channel-communication portion 340 so that the dirt m collected in the collection space S is not discharged to the circulation channel 324. The flow stopper 415 may be disposed in the circulation channel opening 412*b*. Since the housing 410 is disposed in the collection space S, it is assumed that the dirt m received in the housing 410 is collected in the collection space S. The flow stopper 415 may be disposed in the housing 410 or the pulsator 310. The flow stopper 415 may be laid in the collection space S or may be laid in the direction of the circulation channel 324.

The washing machine 300 may further include a locking step 417 restricting movement of the flow stopper 415 so that the flow stopper 415 pivots in the collection space S. The locking step 417 restricts the pivot motion of the flow stopper 415 within a predetermined range. When the pulsator 310 stops rotating, the washing water in the collection space S may flow backward to the circulation channel 324. Since the locking step 417 limits the amount of pivot of the flow stopper 415, it is possible to prevent backward flow of the washing water.

The washing machine 300 includes separation ribs 339 disposed in the collection space S to divide the washing water flowing in the collection space S. When the housing 410 is inserted in the collection space S, the separation ribs 339 may be formed in the housing 410. The separation ribs 339 uniformly distribute the turning water through the filtering portion 420.

Referring to FIG. 19, as the pulsator 310 rotates, the washing water in the circulation channel 324 is radially pushed. The washing water in the outer tub 2 flows through an inlet hole h (w1) in order to fill the empty space formed by the pushed washing water. The dirt m in the outer tub 2 also flows to the circulation channel 324. The dirt m and the washing water in the circulation channel 324 are pushed to the filter 400 by a centrifugal force (w2 and w3). The washing water is sprayed into the inner tub through the filtering portion 420 (w4). The dirt m is stuck to the filtering portion 420 and left in the collection space S. The filtering portion 420 has a mesh shape with a plurality of holes, such that washing water is sprayed under high pressure. The sprayed washing water circulates laundry La in the outer tub 2.

Although exemplary embodiments of the present invention were illustrated and described above, the present invention is not limited to the specific exemplary embodiments and may be modified in various ways by those skilled in the art without departing from the scope of the present invention described in claims, and the modified examples should not be construed independently from the spirit or the scope of the present invention.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

an inner tub that receives laundry;

a pulsator disposed in the inner tub;

a motor that rotates the pulsator; and guides disposed on the pulsator, wherein the pulsator includes a side wall that is disposed at an outside portion of the pulsator and is vertically elongated, and wherein each of the guides includes:

an edge that is positioned between the side wall and a center axis of the inner tub and is vertically elongated;

a first inclined surface that connects the edge with the side wall, is inclined toward the side wall, and is disposed at one side of the edge in a first circumferential direction; and a second inclined surface that connects the edge with the side wall, is inclined toward the side wall, and disposed at another side of the edge in a second circumferential direction.

2. The washing machine of claim 1, further comprising a water supplying pump that adjusts an amount of water flowing into the washing machine, wherein the guides are curved to guide washing water within the inner tub so that the washing water is pushed outward from a rotational center in a curved path to return to the rotational center.

3. The washing machine of claim 1, wherein the first inclined surface and the second inclined surface are symmetric with respect to the edge.

4. The washing machine of claim 1, wherein the pulsator includes:

an inner pulsator; and an outer pulsator disposed outside the inner pulsator, rotating in an opposite direction relative to the inner pulsator, and having the guides.

5. The washing machine of claim 1, wherein the side wall is disposed on a lower portion of the inner tub.

6. The washing machine of claim 1, wherein the inner tub includes:

an inner tub base covering an outer side of the side wall;

an inner tub body disposed above the inner tub base; and an outer anti-sticking rib curved to cover an upper edge of the side wall and formed at a joint of the inner tub base and the inner tub body.

7. The washing machine of claim 4, further comprising:

a sun gear having an inner pulsator-coupling portion coupled to the inner pulsator;

planetary gears engaged with the sun gear;

a ring gear engaged with the planetary gears, on the inner side; and a gear box rotating with the ring gear.

8. The washing machine of claim 7, wherein the pulsator further includes a base pulsator disposed under the outer pulsator, and fastened to the gear box, the base pulsator transmitting torque from the ring gear to the outer pulsator.

9. The washing machine of claim 8, wherein a sun gear hole, through which the inner pulsator-coupling portion passes, is formed through the base pulsator.

10. The washing machine of claim 4, further comprising a planetary gear set rotating the inner pulsator and the outer pulsator in opposite directions.

11. The washing machine of claim 10, wherein the inner pulsator and the outer pulsator, when rotating maintain different angular speed ratios.

12. The washing machine of claim 1, further comprising an outer tub surrounding the inner tub, wherein the first inclined surfaces and the second inclined surfaces are curved convexly toward the outer tub.

13. The washing machine of claim 1, wherein:

the pulsator includes an inner pulsator, and an outer pulsator disposed outside the inner pulsator, and the outer pulsator includes an extension that is horizontally elongated to extend from a lower portion of the side wall toward the center axis of the inner tub.

14. The washing machine of claim 13, wherein the extension is disposed between an inner side of the side wall and an outer side of the inner pulsator.

15. The washing machine of claim 1, further comprising a water pump that adjusts an amount of water flowing into the washing machine, wherein the guides direct washing water, which is turned circumferentially in the inner tub, to the rotational center axis of the inner tub.

16. The washing machine of claim 1, wherein the first inclined surface and the second inclined surface are curved convexly toward the center axis of the inner tub.

17. The washing machine of claim 1, wherein the first inclined surface and the second inclined surface are curved convexly toward the outside portion of the pulsator.

18. The washing machine of claim 1, wherein the first inclined surface and the second inclined surface are formed concavely.

19. The washing machine of claim 1, wherein the first inclined surface and the second inclined surface are formed concavely toward the outside portion of the pulsator.

20. The washing machine of claim 1, wherein the first inclined surface and the second inclined surface are formed concavely toward the first circumferential direction.

* * * * *